US007322619B2

(12) United States Patent
Nolte et al.

(10) Patent No.: US 7,322,619 B2
(45) Date of Patent: Jan. 29, 2008

(54) INTEGRATED LOCK AND TILT-LATCH MECHANISM FOR A SLIDING WINDOW

(75) Inventors: Douglas A. Nolte, Owatonna, MN (US); Kenneth E. Best, Claremont, MN (US); Clark A. Velzke, Medford, MN (US); Edward J. Subliskey, Mountaintop, PA (US); Anthony J. Rotondi, Fairfield, IA (US); Glen Wolf, Owatonna, MN (US)

(73) Assignee: Truth Hardware Corporation, Owatonna, MN (US)

( * ) Notice: Subject to any disclaimer, the term of this patent is extended or adjusted under 35 U.S.C. 154(b) by 0 days.

(21) Appl. No.: 11/340,428

(22) Filed: Jan. 26, 2006
(Under 37 CFR 1.47)

(65) Prior Publication Data

US 2007/0029810 A1 Feb. 8, 2007

Related U.S. Application Data

(60) Provisional application No. 60/647,112, filed on Jan. 26, 2005, provisional application No. 60/716,455, filed on Sep. 13, 2005.

(51) Int. Cl.
*E05C 1/10* (2006.01)

(52) U.S. Cl. ..... 292/175; 49/185

(58) Field of Classification Search ..... 292/175, 292/34, 38, DIG. 20, DIG. 47; 49/183–185
See application file for complete search history.

(56) References Cited

U.S. PATENT DOCUMENTS

| | | | |
|---|---|---|---|
| 49,592 | A | 8/1865 | Richards |
| 166,842 | A | 8/1875 | Berryman |
| 403,847 | A | 5/1889 | Langenbach |
| 480,148 | A | 8/1892 | Theby |
| 540,911 | A | 6/1895 | George |
| 784,446 | A | 3/1905 | Taylor et al. |
| 912,378 | A | 2/1909 | Jackson |
| 1,516,628 | A | 11/1924 | Blackwell |
| 1,704,946 | A | 3/1929 | Lindgren |
| 2,055,289 | A | 9/1936 | Hanan |
| 2,309,437 | A | 1/1943 | Blodgett |

(Continued)

FOREIGN PATENT DOCUMENTS

| | | | |
|---|---|---|---|
| GB | 2 026 594 | A | 2/1980 |

(Continued)

*Primary Examiner*—Jennifer H. Gay
*Assistant Examiner*—Kristina R Gluchowski
(74) *Attorney, Agent, or Firm*—Patterson, Thuente, Skaar & Christensen, PA

(57) ABSTRACT

A low-cost combination tilt-lock-latch mechanism for a sliding window that combines ease of installation and adjustment with simplicity of use. The mechanism includes at least one tilt-latch mechanism adapted for mounting in the window sash. The tilt-latch mechanism includes a housing and a plunger having a latch bolt portion retractable within the housing. A plunger latch member automatically latches the plunger in a retracted position to enable tilting of the sash. Further, the mechanism may include an actuator mechanism and a flexible linking member. The tilt-latch may include a locking member adjustable from outside the housing of the tilt latch, to lock the flexible linking member to the plunger, thereby operably coupling the actuator mechanism with the tilt-latch.

23 Claims, 39 Drawing Sheets

U.S. PATENT DOCUMENTS

| | | | |
|---|---|---|---|
| 2,500,849 | A | 3/1950 | Menns |
| 2,934,370 | A | 4/1960 | Love et al. |
| 3,027,188 | A | 3/1962 | Eichstadt |
| 3,683,652 | A | 8/1972 | Halopoff et al. |
| 3,994,093 | A | 11/1976 | Mayer et al. |
| 4,199,176 | A | 4/1980 | Kelly |
| 4,303,264 | A | 12/1981 | Uehara |
| 4,478,444 | A | 10/1984 | Kurz et al. |
| 5,090,750 | A | 2/1992 | Lindqvist |
| 5,110,165 | A | 5/1992 | Piltingsrud |
| 5,139,291 | A | 8/1992 | Schultz |
| 5,152,103 | A | 10/1992 | Tucker et al. |
| 5,398,447 | A | 3/1995 | Morse |
| RE35,463 | E | 2/1997 | Vetter et al. |
| 5,791,700 | A * | 8/1998 | Biro ..... 292/7 |
| 5,992,907 | A * | 11/1999 | Sheldon et al. ..... 292/34 |
| 6,347,820 | B2 | 2/2002 | Subliskey |
| 6,485,070 | B1 | 11/2002 | Schultz |
| 6,588,150 | B1 | 7/2003 | Wong et al. |
| 6,607,221 | B1 | 8/2003 | Elliott |
| 6,817,142 | B2 | 11/2004 | Marshik |
| 6,877,784 | B2 * | 4/2005 | Kelley et al. ..... 292/241 |
| 7,013,603 | B2 * | 3/2006 | Eenigenburg et al. ..... 49/185 |
| 7,070,211 | B2 | 7/2006 | Polowinczak et al. |

FOREIGN PATENT DOCUMENTS

| | | |
|---|---|---|
| GB | 2 028 415 A | 3/1980 |
| GB | 2 156 896 A | 10/1985 |

* cited by examiner

INTEGRATED LOCK AND TILT-LATCH MECHANISM FOR A SLIDING WINDOW

RELATED APPLICATIONS

This application claims the benefit of U.S. Provisional Application No. 60/647,112, entitled WINDOW LOCK SUITABLE FOR DOUBLE AND SINGLE HUNG WINDOWS, filed Jan. 26, 2005, and U.S. Provisional Application No. 60/716,455, entitled LOCK AND LATCH SYSTEM FOR VINYL WINDOWS, filed Sep. 13, 2005, hereby fully incorporated herein by reference.

FIELD OF THE INVENTION

This invention relates to window locks, and more particularly to window locks for sliding windows.

BACKGROUND OF THE INVENTION

Double-hung windows include two window sashes typically mounted for vertical movement along adjacent parallel tracks in a window frame. Traditional double-hung window designs provide poor washability, because it is difficult for a person located inside a structure in which the window is installed to wash the outside of the window pane. To fully wash the outer surface of such windows (which outer surface is the one which is most often in need of cleaning), the person cleaning the window must typically go outside the dwelling. This is not only extremely inconvenient, as the person has to walk significant distances merely to wash both sides of a single window, but it can also force a window washer, when trying to wash double and single-hung windows located at significant heights, to face the undesirable choice of either risking injury by climbing to that height or doing a relatively poor job of washing by merely reaching from a distance with a hose or a special long pole apparatus of some type. Such cleaning is still further complicated where there are screens or storm windows that must be removed prior to washing.

To overcome this problem, windows of this type have developed that enable one of the sashes to be tilted inwardly to gain access to the outside surface of the window pane from within the structure. Various types of latching mechanisms have been developed to enable the sash to secure the sash in place in the frame, but to also enable tilting the sash by operating the latches. A common arrangement has such latches positioned in opposite ends of a top horizontal rail of the upper and/or lower sash, with each latch typically including a tongue or plunger which during normal operation extends out from the side of the sash into the sash track in the window frame to guide the sash for typical vertical movement. The tongue or plunger of each latch is retracted when washing is desired to free the top rail of the sash from the track so that the sash may be suitably pivoted inwardly about pivots guiding the bottom rail of the sash in the track and thereby allow the washer to easily reach the outside surface of the window pane of that sash.

The tongue or plunger in many of the prior art latches is usually biased outwardly into the track by a spring structure or the like, with the tongue retracted inwardly by the washer manually pulling the tongues in toward the center of the top rail against the force of the spring as, for example, in the mechanism disclosed in U.S. Pat. No. 5,139,291. A drawback of such mechanisms, however, is that both latches must be operated simultaneously, requiring that the operator use both hands. Moreover, simultaneous operation of latch controls spaced at the far edges of the sash can be awkward, especially for wide windows. Another mechanism, disclosed in U.S. Pat. No. 5,992,907, commonly owned by the owners of the present invention and hereby fully incorporated herein by reference, has a lever operably coupled with a check rail lock assembly that simultaneously operates remotely located tilt latch assemblies.

Other mechanisms linking tilt latches with a single control that also locks the sashes together are well known. For example, U.S. Pat. No. 5,398,447 (the '447 patent) discloses a tilt lock latch mechanism wherein a lever positioned proximate the center of the top rail of a lower sash may be rotated in one direction to engage a keeper positioned on the upper sash proximate the lever or in the opposite direction to operate remotely located tilt latches to enable tilting of the lower sash for cleaning. U.S. Pat. No. 5,791,700 (the '700 patent) discloses a tilt lock latch mechanism wherein a single control lever operates both sash locks and remote tilt latches. To accomplish this, the control lever is selectively rotatably positionable in three discrete positions: (1) a first position wherein the sash locks and the tilt latches are engaged; (2) a second position wherein the sash locks are disengaged to enable sliding of the sashes but the tilt latches are still engaged; and (3) a third position wherein the sash locks and the tilt latches are disengaged to enable sliding of the window. Similarly, U.S. Pat. No. 6,817,142 (the '142 patent) and its continuation U.S. application Ser. No. 10/959,696 also disclose a tilt lock latch mechanism having such a three position control lever.

Each of the above described mechanisms, however, has certain drawbacks. The '447 patent mechanism, while generally simple, requires rotation of the control lever in opposite directions from a center position for unlocking and tilting. This is inconvenient and may result in unintended tilting operation of the window if an inexperienced user seeking merely to unlock the window rotates the lever in the wrong direction. Also, the '447 patent mechanism requires that a separate control be manipulated by the operator to maintain the control lever in a desired position. The '700 patent mechanism, while enabling same-direction rotation of the control lever, is relatively complex, and may be expensive to manufacture and difficult to install and adjust. The '142 patent mechanism may be difficult to adjust, requiring partial disassembly and manipulation of a screw on the tilt latches for tensioning the strap connecting the control lever with the tilt latches. Moreover, the '142 patent describes a separate button that must be manipulated for engaging or releasing the tilt latches. This may be confusing for a user and result in frustration when attempting to tilt the window for cleaning, or in failure to properly reengage the tilt latches when cleaning is complete.

Another mechanism, described in U.S. Pat. No. 6,877,784, includes a rotary lever with sash lock that actuates remote tilt latches through an extensible member. A drawback of this mechanism, however, is that it is relatively complex, including a spring-loaded control lever and a pivoting trigger release mechanism in each of the tilt latches, making it relatively more expensive to produce and reducing reliability. Further, there are no simple means provided for attaching the extensible member to the tilt latches, nor is any means for adjusting length and tension of the extensible member provided.

U.S. patent application Ser. No. 10/289,803 discloses a similar tilt lock latch mechanism including a three-position control lever that actuates a sash lock as well as remotely located tilt latches. One drawback of this mechanism, however, is that a relatively complicated fastener arrangement is used for connecting the actuator spool to the tilt latch connector, affecting cost of manufacture and usability of the mechanism. Also, the tilt latches are not equipped with any mechanism for holding the latches in the retracted position. When the window is tilted into position after cleaning, the protruding latch bolts may mar the window frame if the operator forgets to manually retract them. Moreover, a separate button is described that must be manipulated for engaging or releasing the tilt latches, thus complicating operation.

What is still needed is a low-cost combination tilt-lock-latch mechanism for a double hung window that is easy to install and adjust, and simple to use.

SUMMARY OF THE INVENTION

The present invention addresses the need for a low-cost combination tilt-lock-latch mechanism for a sliding window that combines ease of installation and adjustment with simplicity of use. In embodiments of the invention, an integrated lock and tilt-latch mechanism for a sliding window includes at least one tilt-latch mechanism adapted for mounting in the window sash. The tilt-latch mechanism includes a housing presenting a longitudinal axis and having an aperture defined in a first end thereof, a plunger having a latch bolt portion, a plunger latch member, and first and second biasing members. The plunger is disposed in the housing and is selectively slidably shiftable along the longitudinal axis of the housing between an extended position in which the latch bolt portion of the plunger projects through the aperture in the housing to engage the window frame so as to prevent tilting of the sash, and a retracted position in which the latch bolt portion of the plunger is substantially within the housing to enable tilting of the sash. The first biasing member is arranged so as to bias the plunger toward the extended position. The plunger latch member is operably coupled with the tilt-latch housing and is arranged so as to be selectively slidably shiftable in a direction transverse to the longitudinal axis when the plunger is in the retracted position. The plunger latch member is shiftable between a first position in which the plunger latch member engages and prevents shifting of the plunger and a second position in which the plunger latch member enables shifting of the plunger. The second biasing member arranged so as to bias the plunger latch member toward the first position so that when the plunger is retracted, the plunger latch automatically shifts to retain the plunger in the retracted position. The plunger latch may include a trigger portion arranged so that when the sash is tilted into position in the frame, the trigger portion contacts the window frame or second sash, shifting the plunger latch so as to release the plunger. The mechanism further includes an actuator mechanism adapted for mounting on the sash. The actuator mechanism includes a housing, a control on the housing, a lock member, and a tilt-latch actuator member. The lock member and the tilt-latch actuator member are operably coupled with the control. A linking member operably couples the tilt-latch actuator member and the plunger of the tilt-latch mechanism. The control is selectively positionable among at least three positions including a locked position in which the lock member is positioned so that a portion of the lock member extends from the housing of the actuator mechanism, an unlocked position in which the lock member is positioned substantially within the housing of the actuator mechanism, and a tilt position in which the lock member is positioned substantially within the housing of the actuator mechanism and the plunger of the tilt-latch mechanism is positioned in the retracted position.

In another embodiment of the invention, an integrated lock and tilt-latch mechanism for a sliding window having a frame with at least one sliding sash therein, the sash also tiltably positionable relative to the frame, includes an actuator mechanism and at least one tilt-latch adapted for mounting on the sash, and a flexible linking member. The actuator mechanism includes a housing, a control, a lock member, and a tilt-latch actuator member. The lock member and the tilt-latch actuator member are operably coupled with the control, and the tilt-latch actuator has structure for receiving and applying tension to the flexible linking member. The at least one tilt-latch includes a tilt-latch housing presenting a longitudinal axis and having an aperture defined in a first end thereof. A plunger is disposed in the tilt-latch housing, the plunger having a latch bolt portion and being selectively slidably shiftable along the longitudinal axis between an extended position in which the latch bolt portion of the plunger projects through the aperture and a retracted position in which the latch bolt portion of the plunger is substantially within the tilt-latch housing. The plunger defines a channel for receiving the flexible linking member and has a locking member positioned proximate the channel. The locking member is selectively shiftably adjustable from a location outside the tilt-latch housing between a first position in which the flexible linking member is freely slidable in the channel to enable insertion and removal of the flexible linking member, and a second position in which the locking member is engaged with the flexible linking member to fixedly secure the flexible linking member in the channel, thereby operably coupling the tilt-latch actuator with the plunger of the tilt-latch. The control is selectively positionable between at least three positions including a locked position in which the lock member is positioned so that a portion of the lock member extends from the housing of the actuator mechanism, an unlocked position in which the lock member is positioned substantially within the housing of the actuator mechanism, and a tilt position in which the lock member is positioned substantially within the housing of the actuator mechanism and the plunger of the tilt-latch mechanism is positioned in the retracted position.

In a further embodiment of the invention, a window includes a frame, a first sash and a second sash, each slidable in the frame. The first sash is also tiltably positionable relative to the frame. An integrated lock and tilt-latch mechanism is positioned on the first sash, including an actuator mechanism and at least one tilt-latch adapted for mounting on the sash, and a flexible linking member. The actuator mechanism inlcudes a housing, a control, a lock member, and a tilt-latch actuator member. The lock member and the tilt-latch actuator member are operably coupled with the control and the tilt-latch actuator has structure for receiving and applying tension to the flexible linking member. The at least one tilt-latch includes a tilt-latch housing presenting a longitudinal axis and having an aperture defined in a first end thereof, and a plunger disposed in the tilt-latch housing. The plunger has a latch bolt portion and is selectively slidably shiftable along the longitudinal axis between an extended position in which the latch bolt portion of the plunger projects through the aperture and a retracted position in which the latch bolt portion of the plunger is substantially within the tilt-latch housing. The plunger defines a channel for receiving the flexible linking member and has a locking member positioned proximate the channel. The locking member is selectively shiftably adjustable, from a location outside the tilt-latch housing, between a first position in which the flexible linking member is freely slidable in the channel to enable insertion and removal of the flexible linking member, and a second position in which the locking member is engaged with the flexible linking member to fixedly secure the flexible linking member in the channel, thereby operably coupling the tilt-latch actuator with the plunger of the tilt-latch. The control is selectively positionable between at least three positions including a locked position in which the lock member is positioned so that a portion of the lock member extends from the housing of the actuator mechanism, an unlocked position in which the lock member is positioned substantially within the housing of the actuator mechanism, and a tilt position in which the lock member is positioned substantially within the housing of the actuator mechanism and the plunger of the tilt-latch mechanism is positioned in the retracted position.

In yet another embodiment of the invention, a window includes a frame, a first sash and a second sash, each slidable in the frame, wherein the first sash is also tiltably positionable relative to the frame. An integrated lock and tilt-latch mechanism is positioned on the first sash, the mechanism including at least one tilt-latch mechanism having a housing presenting a longitudinal axis, a plunger having a latch bolt portion, a plunger latch member, and first and second biasing members. The plunger is disposed in the housing and is selectively slidably shiftable along the longitudinal axis between an extended position in which the latch bolt portion of the plunger engages the frame of the window to prevent tilting of the first sash and a retracted position in which the latch bolt portion of the plunger is substantially within the housing to enable tilting of the first sash. The first biasing member is arranged so as to bias the plunger toward the extended position. The plunger latch member is operably coupled with the housing and arranged so as to be selectively slidably shiftable in a direction transverse to the longitudinal axis when the plunger is in the retracted position. The plunger latch member is shiftable between a first position in which the plunger latch member engages and prevents shifting of the plunger and a second position in which the plunger latch member enables shifting of the plunger. The second biasing member is arranged so as to bias the plunger latch member toward the first position. The mechanism further includes an actuator mechanism including a housing, a control on the housing, a lock member, and a tilt-latch actuator member. The lock member and the tilt-latch actuator member are operably coupled with the control with a linking member operably coupling the tilt-latch actuator member and the plunger of the at least one tilt-latch mechanism. The control is selectively positionable among at least three positions including a locked position in which the lock member is engaged with the second sash to prevent relative sliding movement of the first and second sashes, an unlocked position in which the lock member is free from contact with the second sash, and a tilt position in which the lock member is free from contact with the second sash and the plunger of the tilt-latch mechanism is positioned in the retracted position to enable tilting of the first sash.

DETAILED DESCRIPTION OF THE PREFERRED EMBODIMENTS

Figure 4:
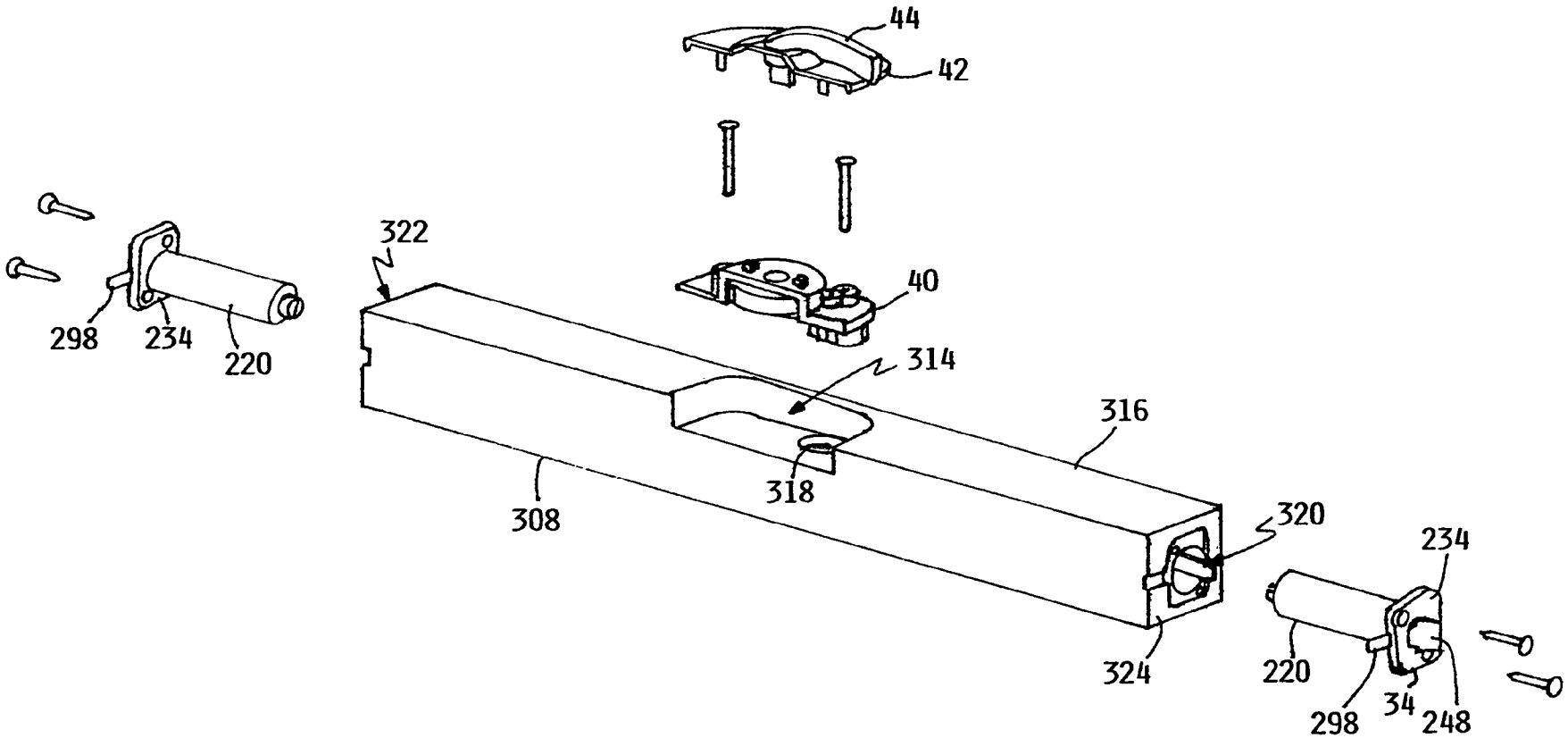
FIG. 4 is an exploded view of the assembly depicted in FIG. 3.
Figure 5:
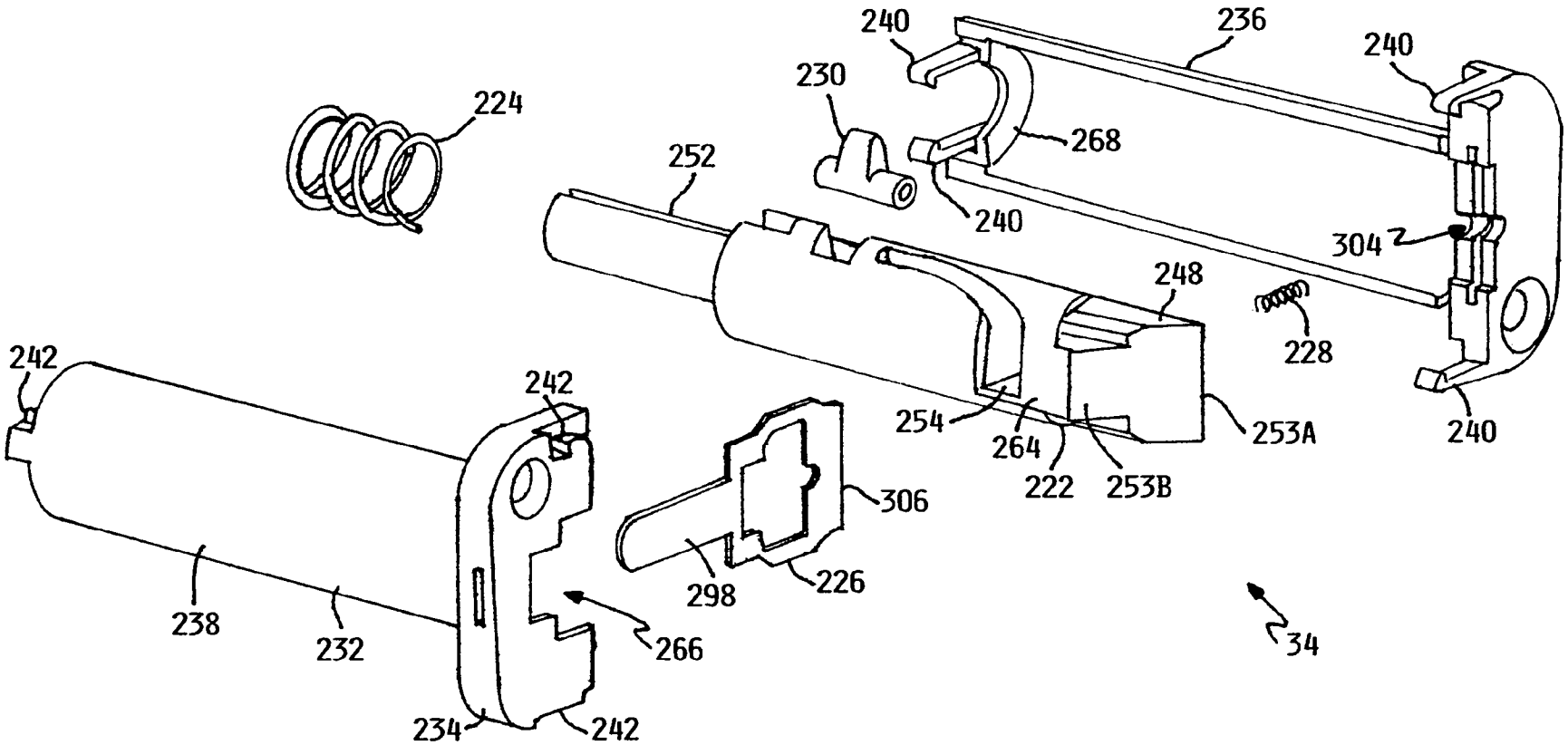
FIG. 5 is an exploded view of a tilt-latch assembly according to an embodiment of the invention.
Figure 6:
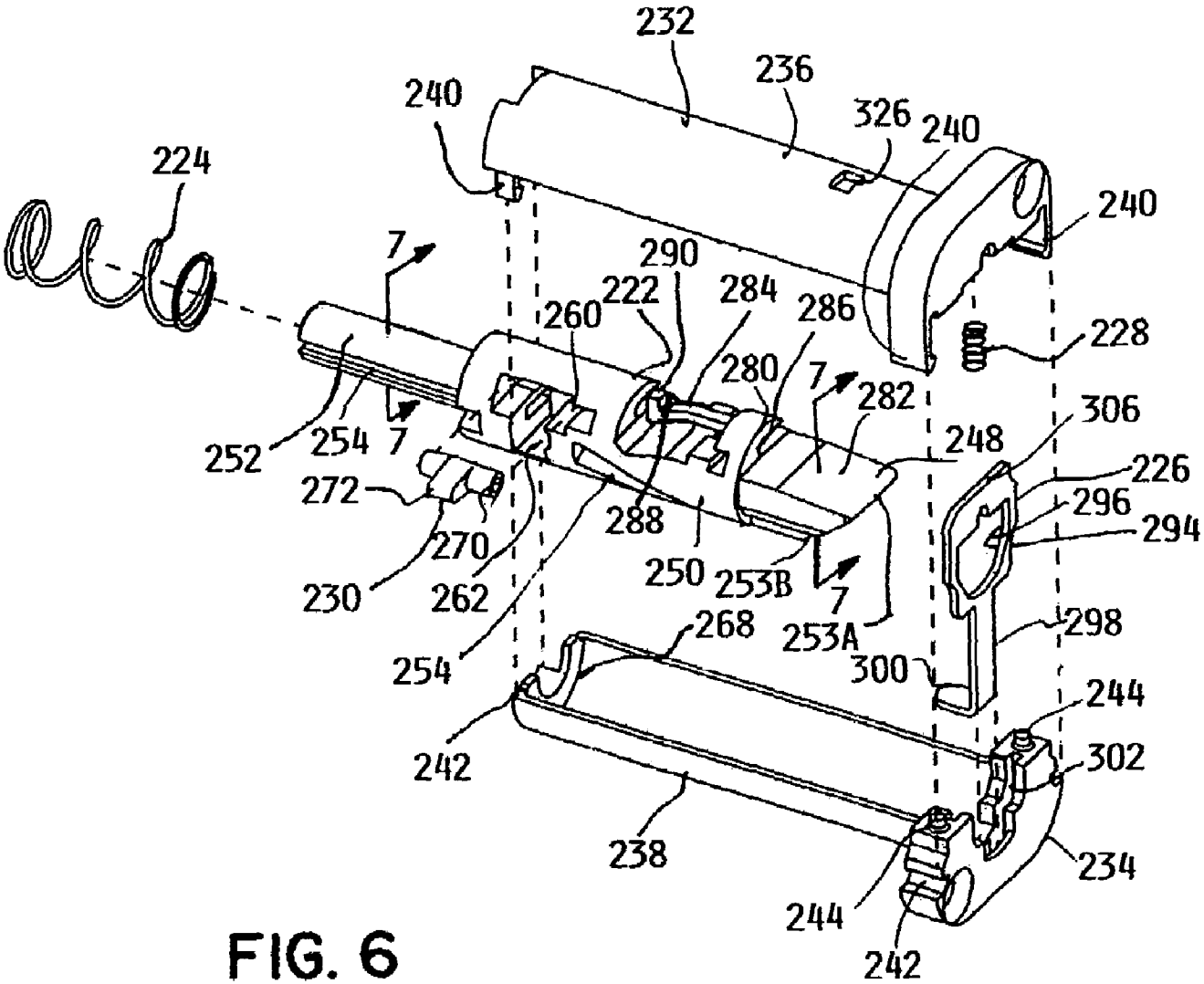
FIG. 6 is an exploded view of a tilt-latch assembly according to another embodiment of the invention.
Figure 7:
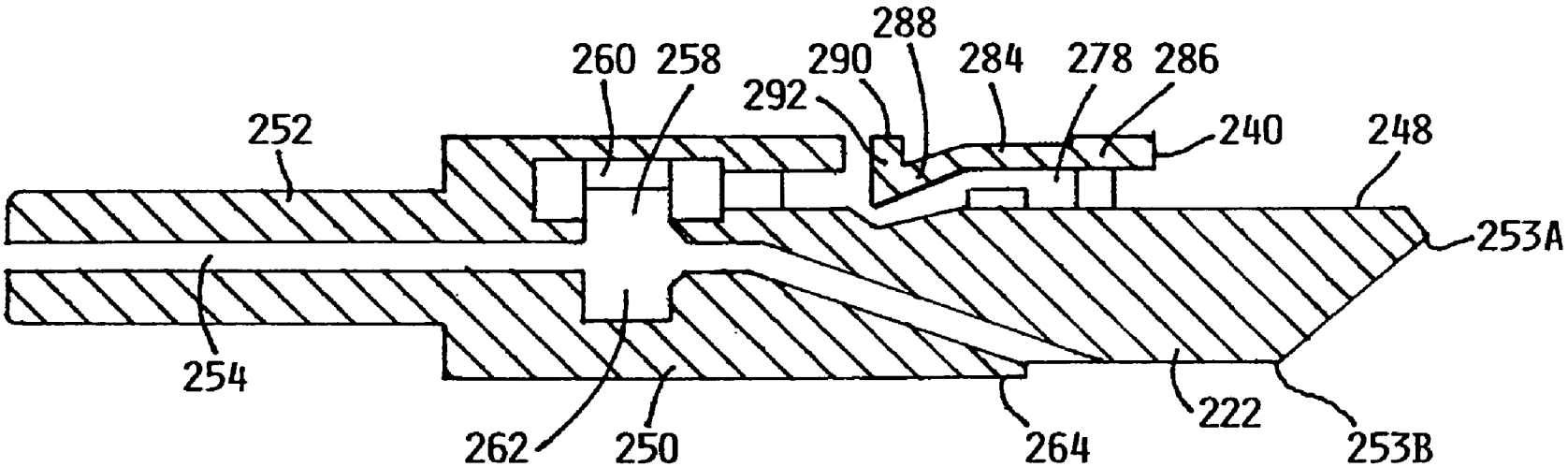
FIG. 7 is a cross-sectional view of the plunger portion of the tilt-latch assembly of FIG. 6 taken at Section 7-7 of FIG. 6.
Figure 8:
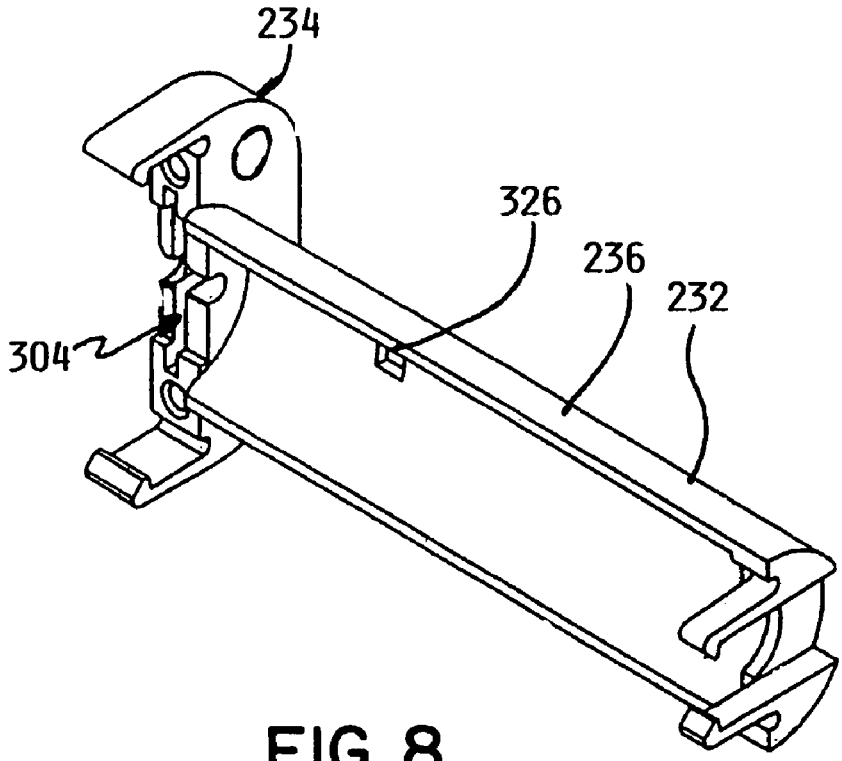
FIG. 8 is a perspective view of a first portion of the housing of the tilt latch assembly of FIG. 6.
Figure 9:
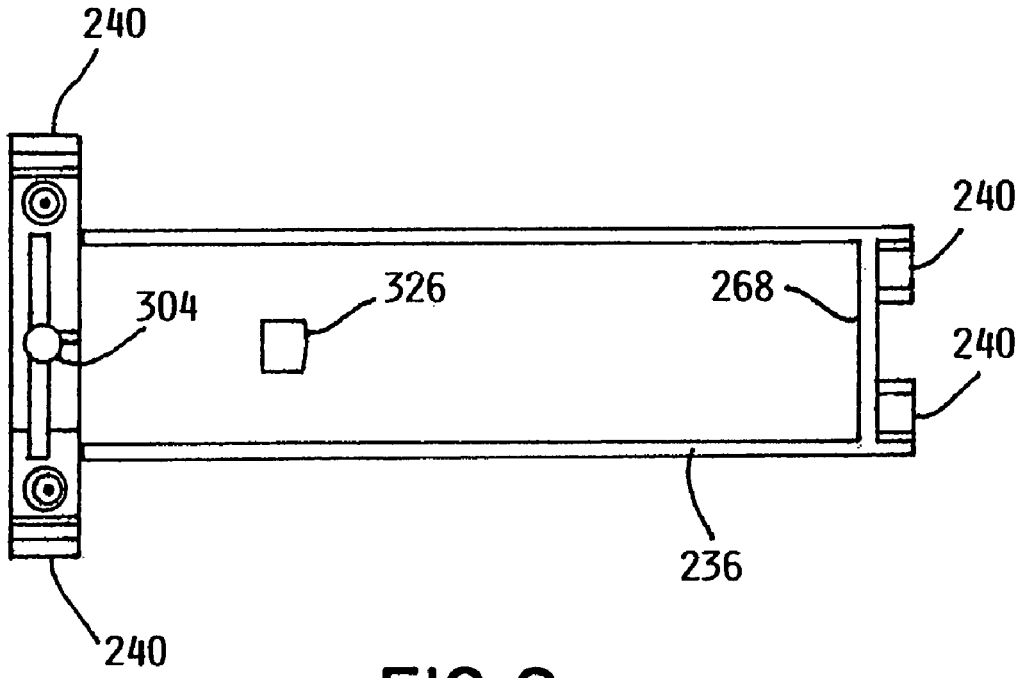
FIG. 9 is a side elevation view of the housing portion depicted in FIG. 8.
Figure 10:
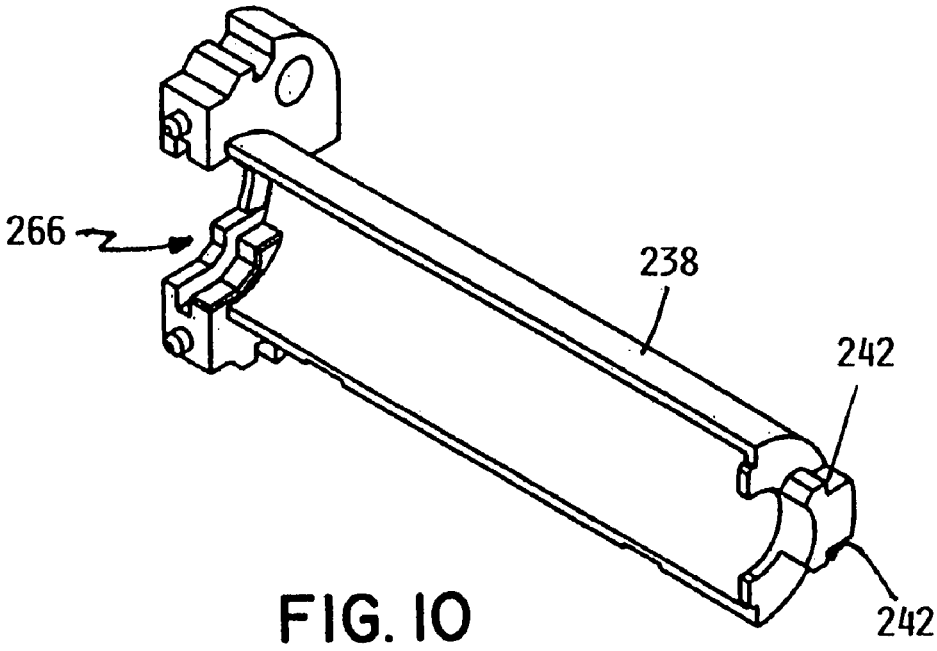
FIG. 10 is a perspective view of a second portion of the housing of the tilt latch assembly of FIG. 6.
Figure 11:
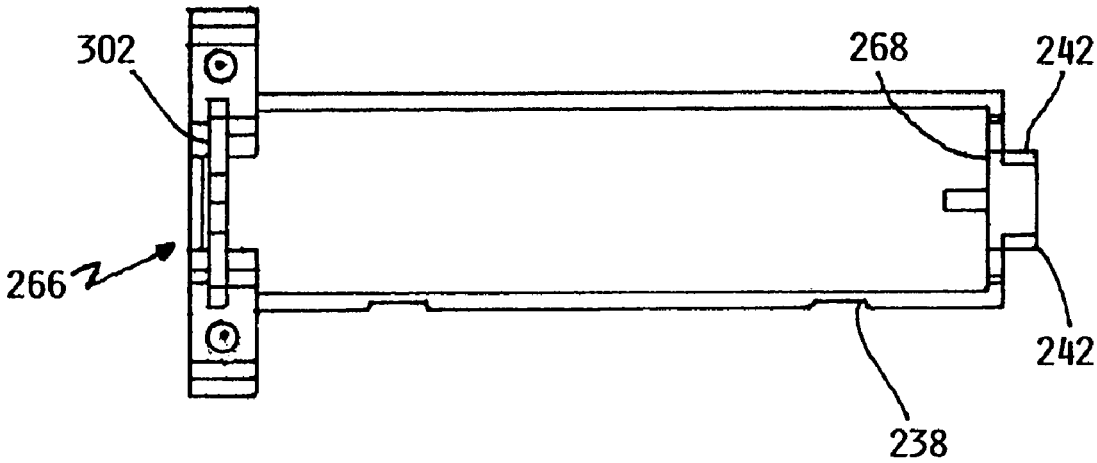
FIG. 11 is a side elevation view of the housing portion depicted in FIG. 10.
Figure 12:
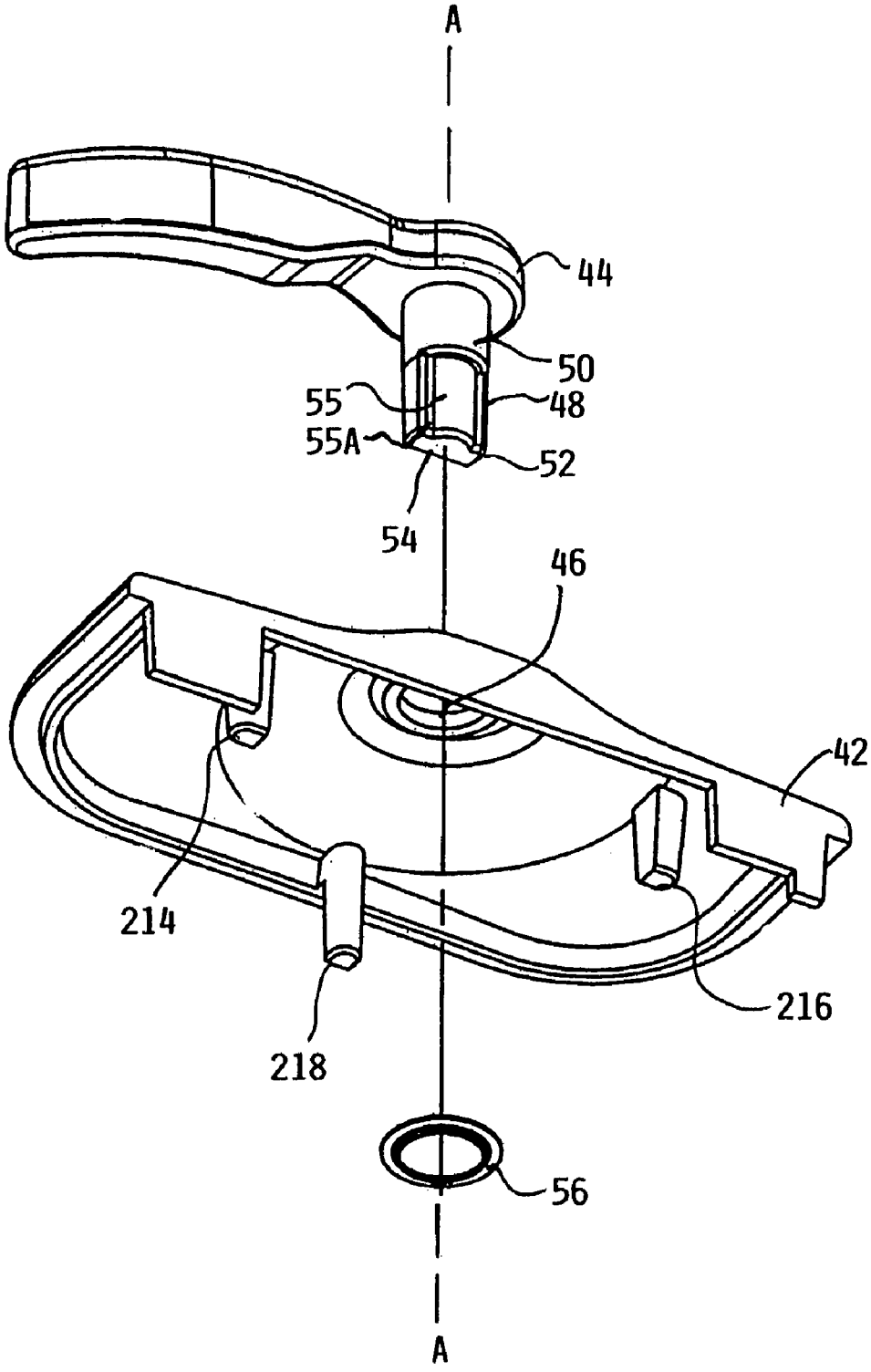
FIG. 12 is a bottom perspective view of a housing cover and control lever according to an embodiment of the present invention.
Figure 13:
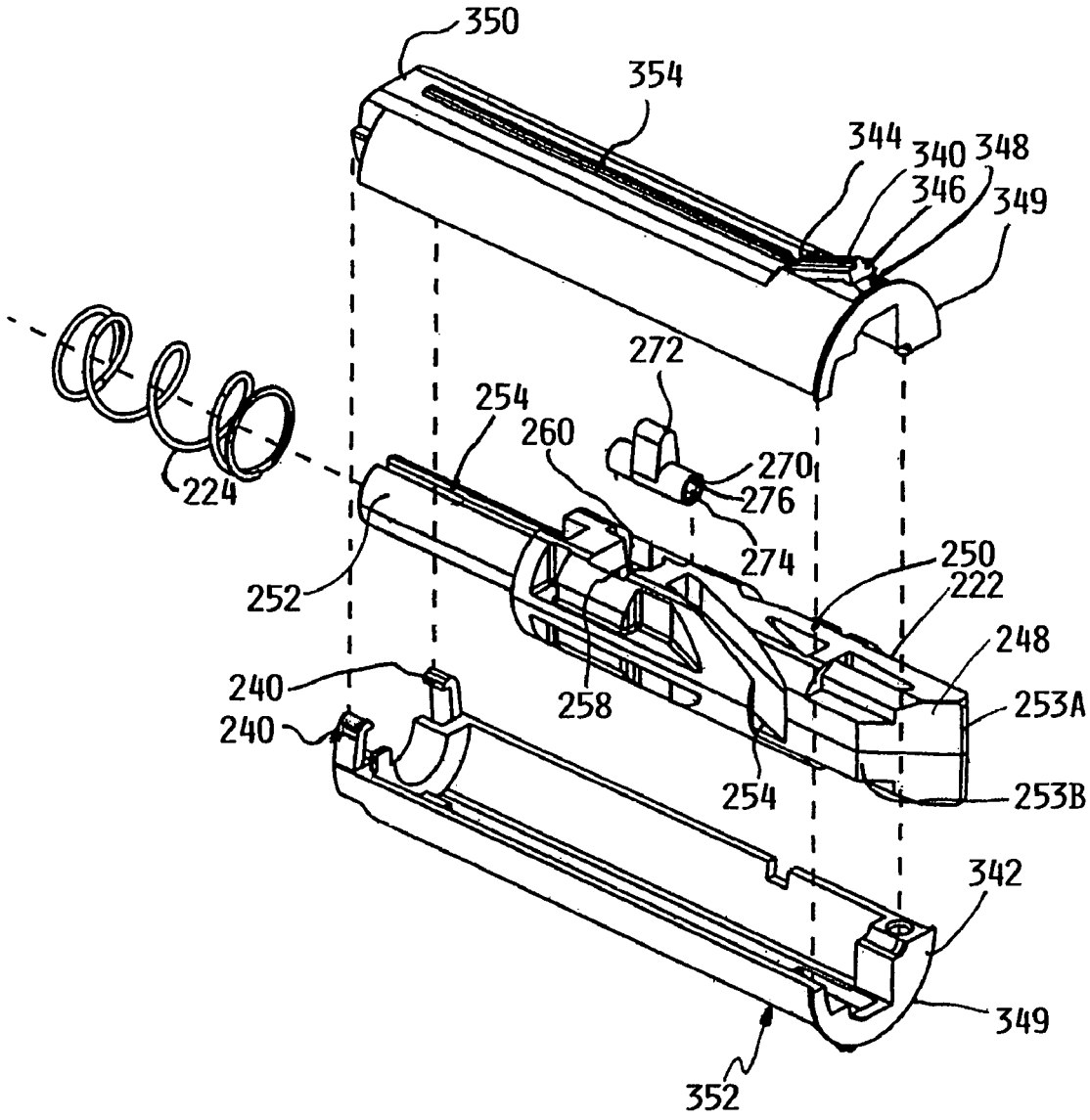
FIG. 13 is an exploded view of a tilt-latch assembly according to yet another embodiment of the invention.

As depicted in FIG. 4, tilt lock latch assembly 30 generally includes actuator assembly 32, tilt latch assemblies 34, and linking member 36. Actuator assembly 32 generally includes a housing 38 defined by base assembly 40 and housing cover 42. Control lever 44 is coupled with housing cover 42 through aperture 46, which receives shank 48 of lever 44 therethrough. Shank 48 has upper portion 50 which is generally cylindrical in shape and lower portion 52 which defines flats 54, 54A. Full height protuberance 55 extends outwardly from flat 54A, while half height protuberance 55A extends outwardly from flat 54. Retainer 56 is received on upper portion 50 of shank 48 and retains lever 44 on housing cover 42 so that lever 44 is rotatable about axis A-A relative to housing cover 42 as annotated in FIG. 12.

As depicted in FIGS. 14-17 and 44-46, base assembly 40 generally includes body 58, sweep cam 60, spool 62, detent spring 64, housing retainer 66, and pick plate 68. Underside 70 of body 58 defines semicircular recess 72 which receives sweep cam 60, and shallow recess 74 which receives pick plate 68. Aperture 76 extends through from recess 72 to top surface 78 of body 58. Boss 80 surrounds aperture 76 in recess 72, and defines inner recess 81 around aperture 76. Spring receiver 82 intersects with inner recess 81 at inner edge 84 of aperture 76. Detent spring 64 is received in spring receiver 82 with point 86 of bend 88 facing away from aperture 76. Stop 89 projects from boss 80 adjacent back edge 89A of body 58. Spool housing 90 projects downwardly from underside 70 and generally includes inner wall 92, outer wall 94 and spool detent 96. Inner wall 92 and outer wall 94 define slots 98, 100, which are aligned in the longitudinal direction of body 58. Chamfers 101 may be provided at the edges of slots 98, 100. Aperture 102 extending through body 58 to top surface 78 is defined in top wall 104 of spool housing 90. Spool detent 96 is positioned adjacent inner wall 92 and has projection 106 at bottom end 108 extending inwardly toward spool housing 90.

Shallow recess 74 is shaped conformingly with and receives pick plate 68. Pivot post 109 is positioned at end 109A of recess 74 and has a pair of branches 109B, 109C, each with an outwardly extending projection 109D at the bottom end thereof. Tab 109E extends inwardly toward 72 from opposite edge 109F of recess 74.

Sweep cam 60 has shaft portion 110 defining opening 112 and cam portion 114 extending radially from shaft portion 110, as depicted in FIGS. 25-28. Opening 112 has generally flat sides 116, 118, but with full height notch 120 formed in side 118, and half-height notch 121 formed in side 116 and extending half the length of opening 112 from end 121A of shaft portion 110. Cam portion 114 has outer wall 122 spaced apart and connected with shaft portion 110 by web 124. Circumferential recess 125 is defined in web 124. Leading edge 126 of outer wall 122 is tapered upwardly from tip 128 to shoulder 130, at which point the full height of outer wall 122 is reached. Gear segment 132 is formed in outer wall 122 at bottom edge 134 opposite leading edge 126 and shoulder 130, and is positioned slightly radially outward from the remainder of outer wall 122. Projections 136, 137, extend outwardly from outer surface 138 of shaft portion 110 proximate web 124. Post 140 projects downwardly from bottom surface 142 of sweep cam 60 proximate opening 112.

Sweep cam 60 is rotatably received in recess 72 of body 58 with bottom surface 142 facing downward and shaft portion 110 extending through aperture 76. Projections 136, 137, travel within inner recess 81, but engage in bend 88 of detent spring 64 to provide detents at two positions in the rotational travel of sweep cam 60. Stop 89 slides within circumferential recess 125. Pick plate 68 defines aperture 144 at narrow end 146, and curved slot 148. Pick plate 68 is received in shallow recess 74 covering sweep cam 60 and retaining it in recess 72. Pivot post 109 is received through aperture 144 so that pick plate 68 is pivotable about pivot post 109 in a narrow path of travel corresponding with shallow recess 74. Curved edge 150 is received under tab 109E while projections 109D extend outwardly on either side of aperture 144 to retain pick plate 68 in position. Post 140 extends through curved slot 148 to enable actuation of pick plate 68 with rotation of sweep cam 60 as described further hereinbelow.

Spool 62 generally includes barrel portion 152 and shaft portion 154 as depicted in FIGS. 20-24. Barrel portion 152 defines slot 156 extending upwardly from bottom edge 158. Mouth 160 of slot 156 may have chamfered edges 162. Gear sector 164 is formed in a portion of top edge 166 of barrel portion 152. Notch 168 is defined in barrel portion 152 near bottom edge 158. Shaft portion 154 extends from barrel portion 152 and includes a pair of branches 170, 172, each with an outward projection 174 proximate end 176.

Spool 62 is rotatably received in spool housing 90 with shaft portion 154 extending through aperture 102. On top surface 78 of body 58, projections 174 extend on either side of aperture 102 to retain spool 62 in spool housing 90. Projection 106 of spool detent 96 engages in notch 168 to form a detent in the rotational travel of spool 62. With projection 106 engaged in notch 168, slot 156 is aligned with slots 98, 100, in spool housing 90.

Top surface 78 of body 58 defines raised portion 178 corresponding with recess 72. Projections 180, 182, extend from raised portion 178 on either side of aperture 76. Posts 184, 186, extend from top surface 78 on either side of raised portion 178. Posts 184, 186, define semicylindrical recesses 188, 190, facing toward raised portion 178. Apertures 192, 194, 196, extend through body 58.

Figure 14:
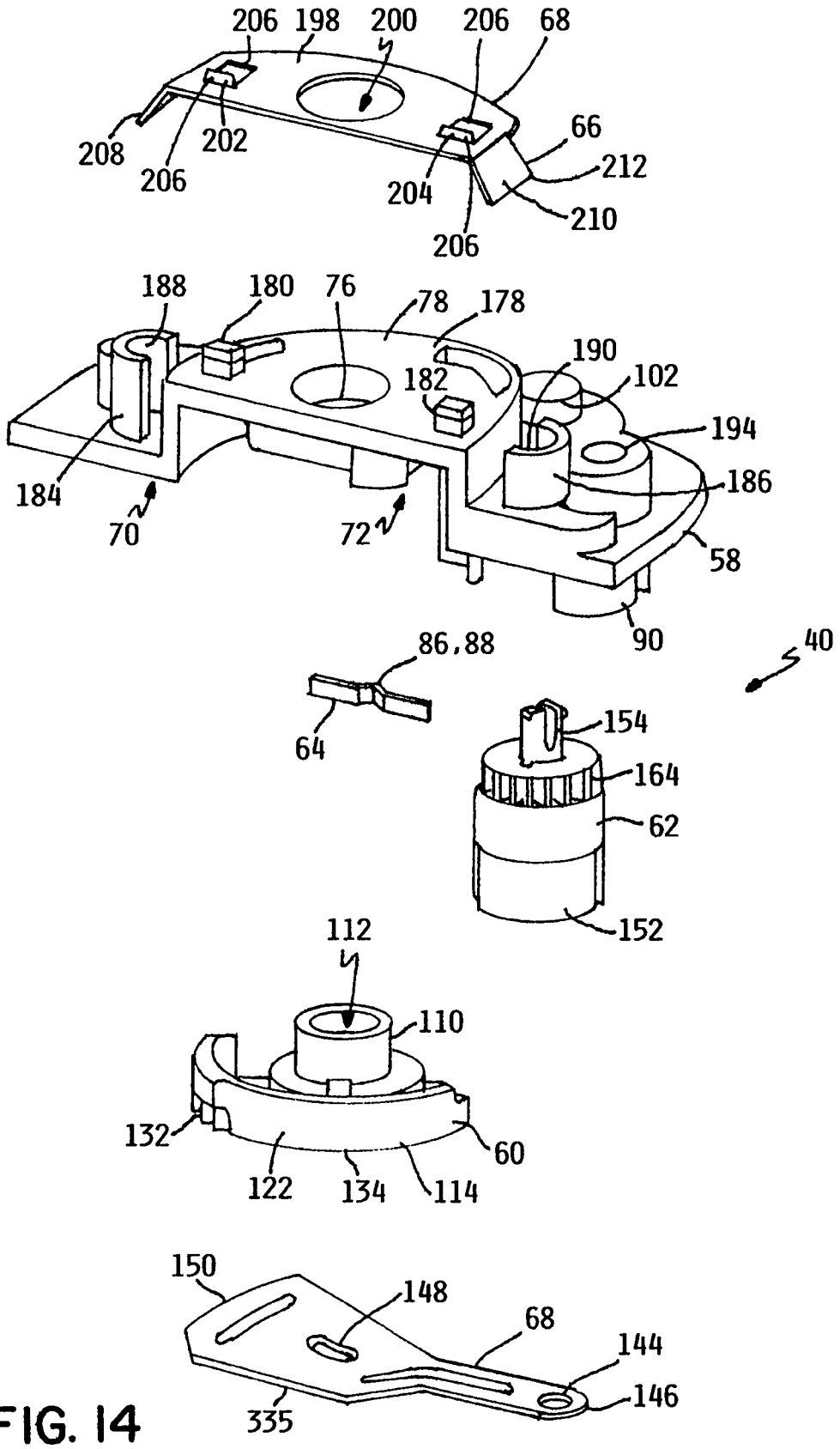
FIG. 14 is an exploded view of the base portion of an actuator assembly according to an embodiment of the invention.
Figure 15:
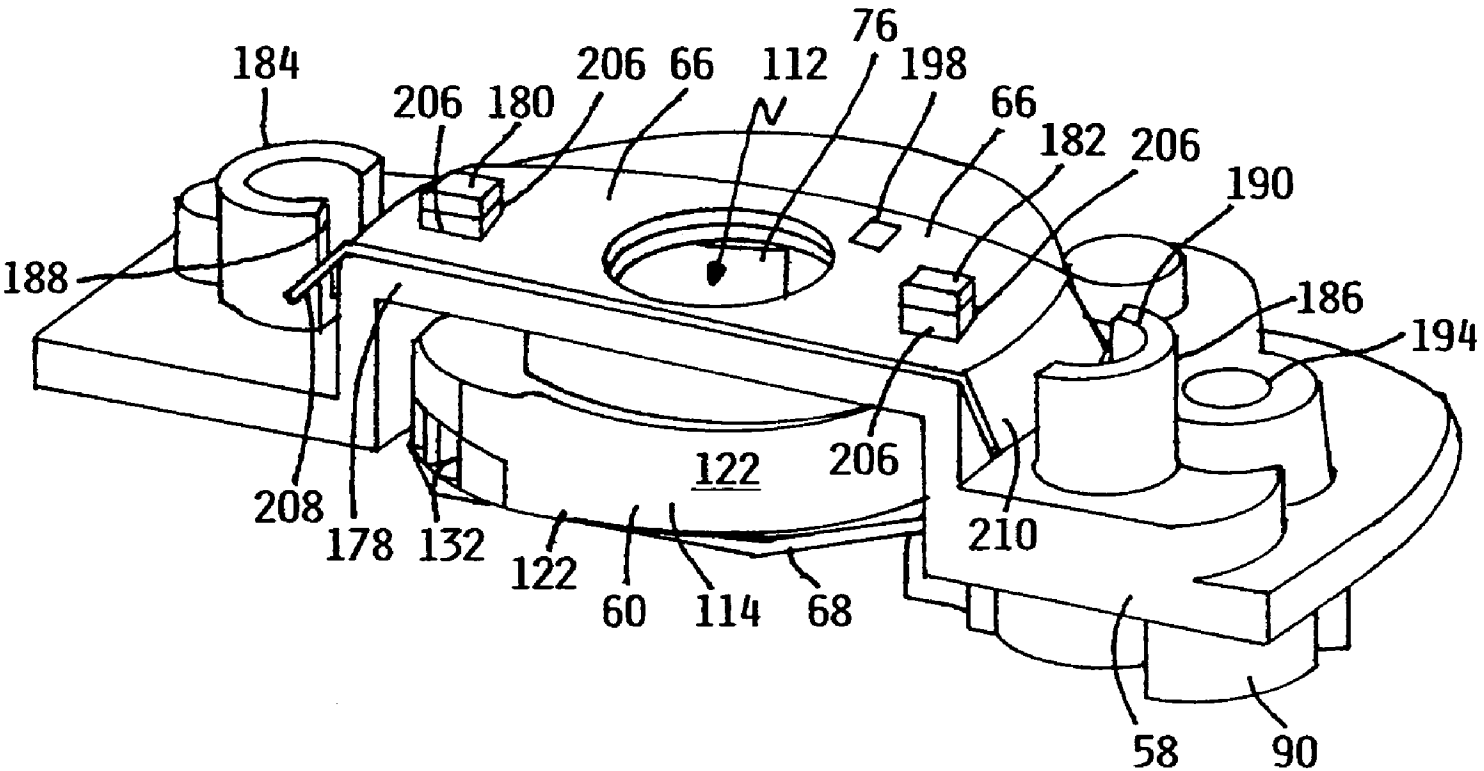
FIG. 15 an assembled view of the base portion of an actuator assembly depicted in FIG. 14.

As depicted in FIGS. 14 and 15, housing retainer 66 has planar central portion 198 defining aperture 200, and square apertures 202, 204. Each square aperture 202, 204, has a pair of upwardly bent tabs 206 on opposing sides thereof. Ears 208, 210, extend outwardly and angle downwardly from the plane defined by central portion 198. Housing retainer 66 is received on raised portion 178 with projections 180, 182, extending through square apertures 202, 204. Tabs 206 engage on the sides of projections 180, 182 to retain housing retainer 66 is place. Outer edges 212 of ears 208, 210, are positioned at the inner side of semicylindrical recesses 188, 190.

Figure 16:
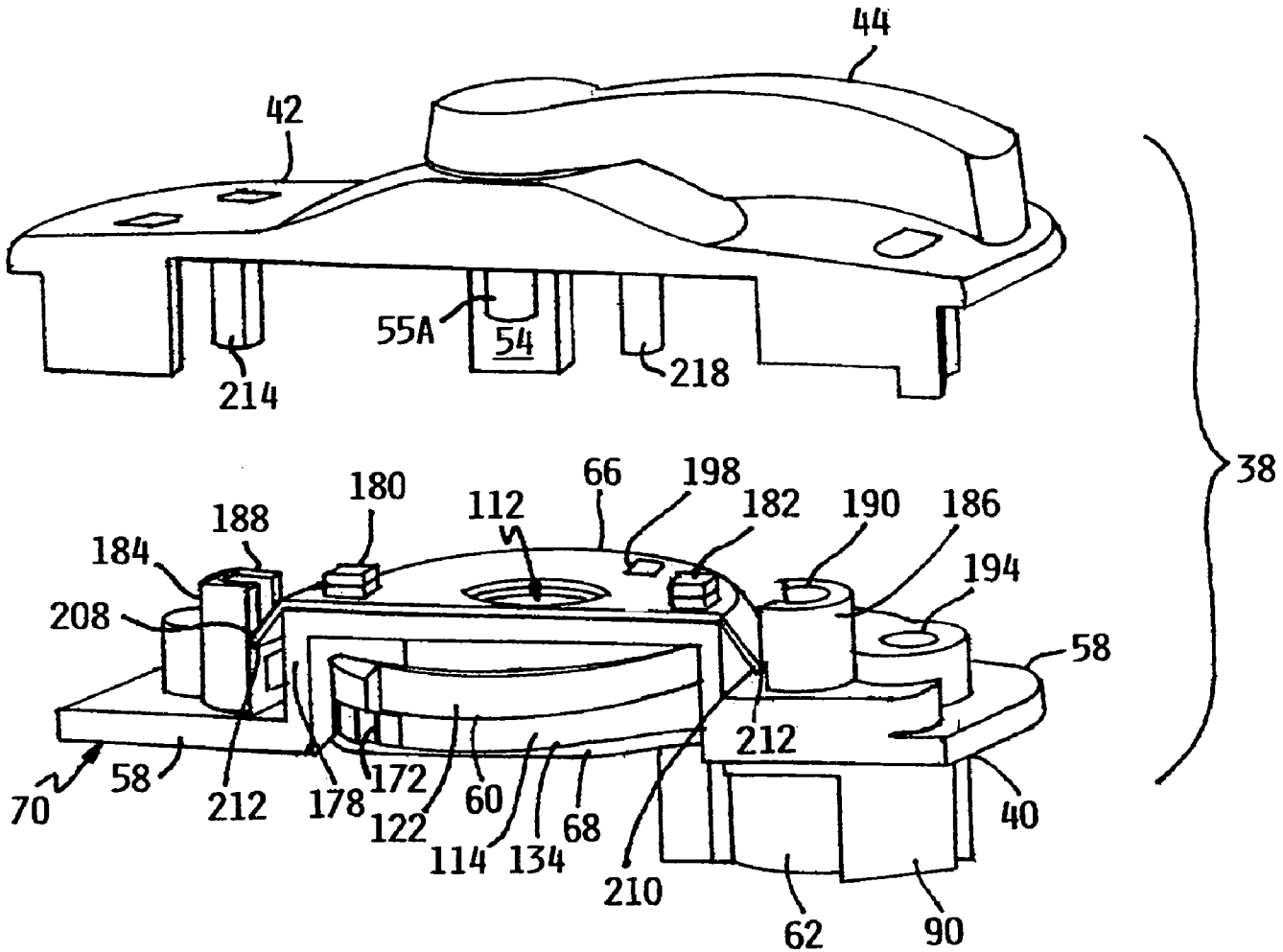
FIG. 16 is an exploded view of an actuator assembly according to an embodiment of the invention.
Figure 17:
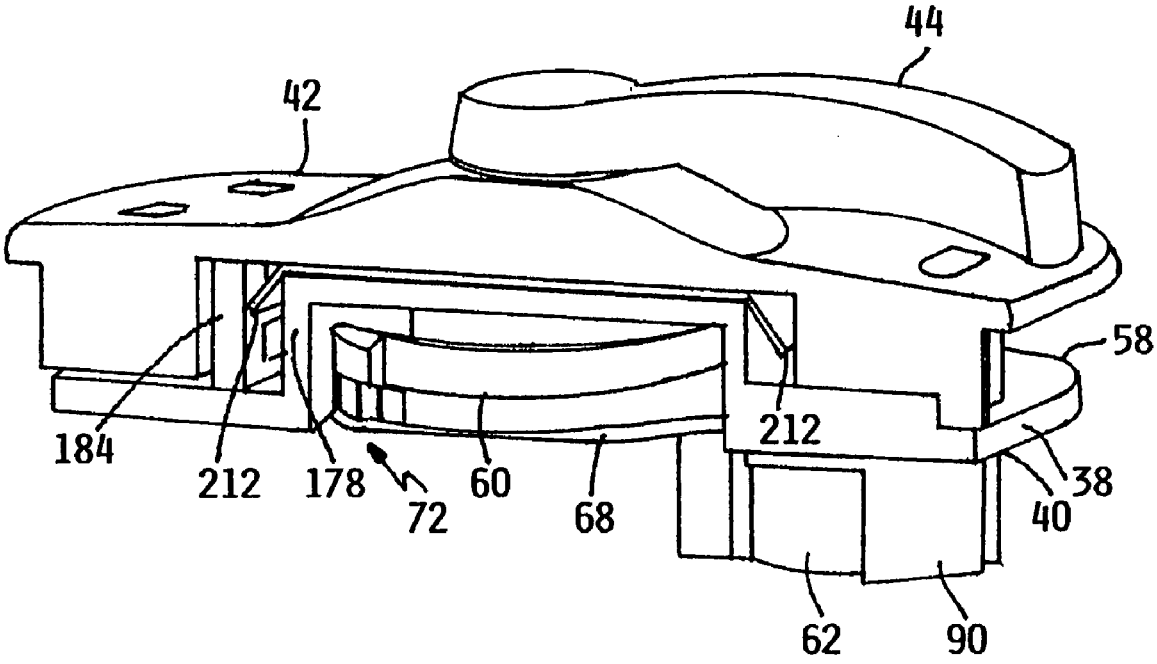
FIG. 17 is an assembled view of the actuator assembly depicted in FIG. 16.
Figure 18:
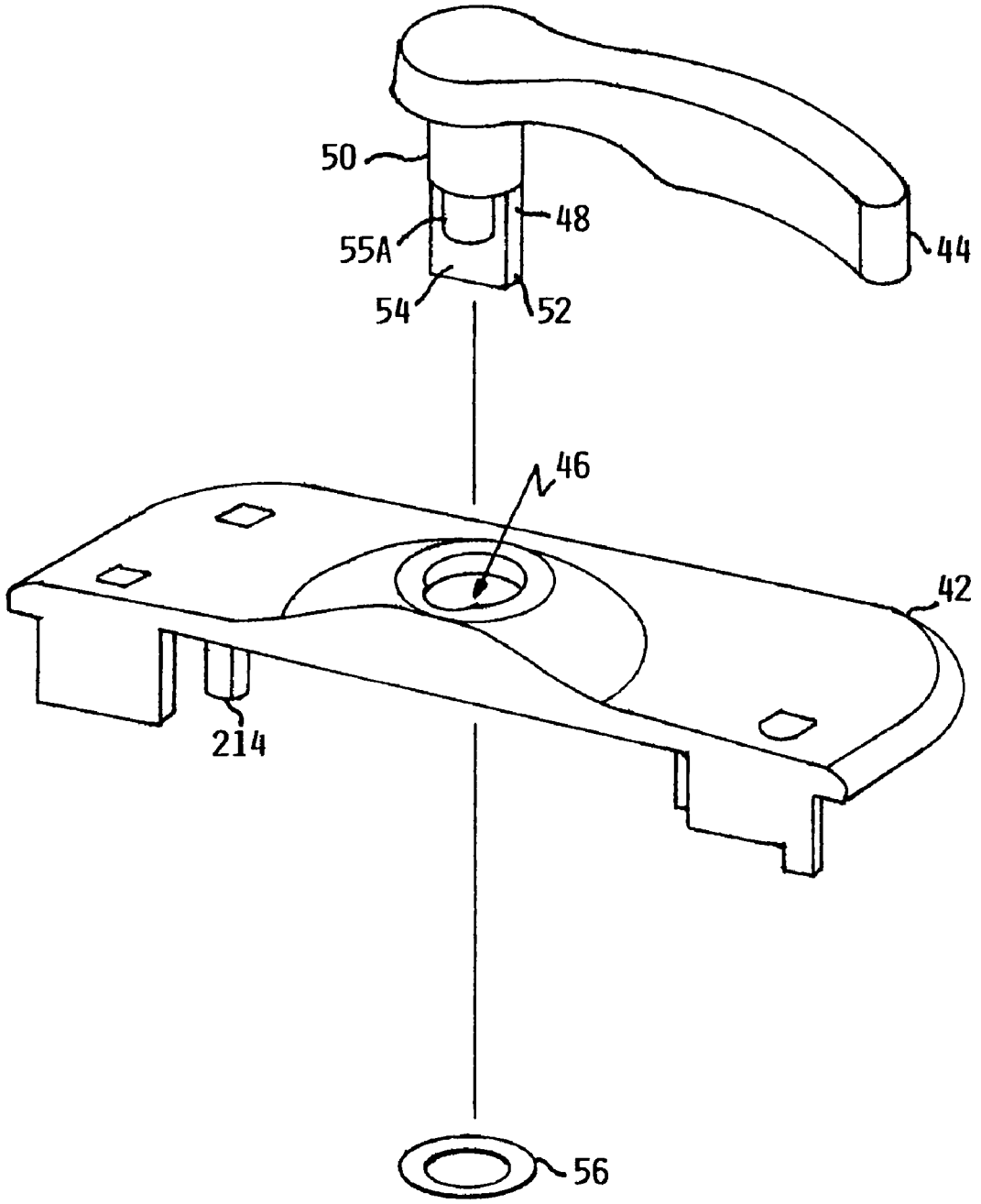
FIG. 18 is an exploded view of the housing cover and control lever of an actuator assembly according to an embodiment of the present invention.
Figure 19:
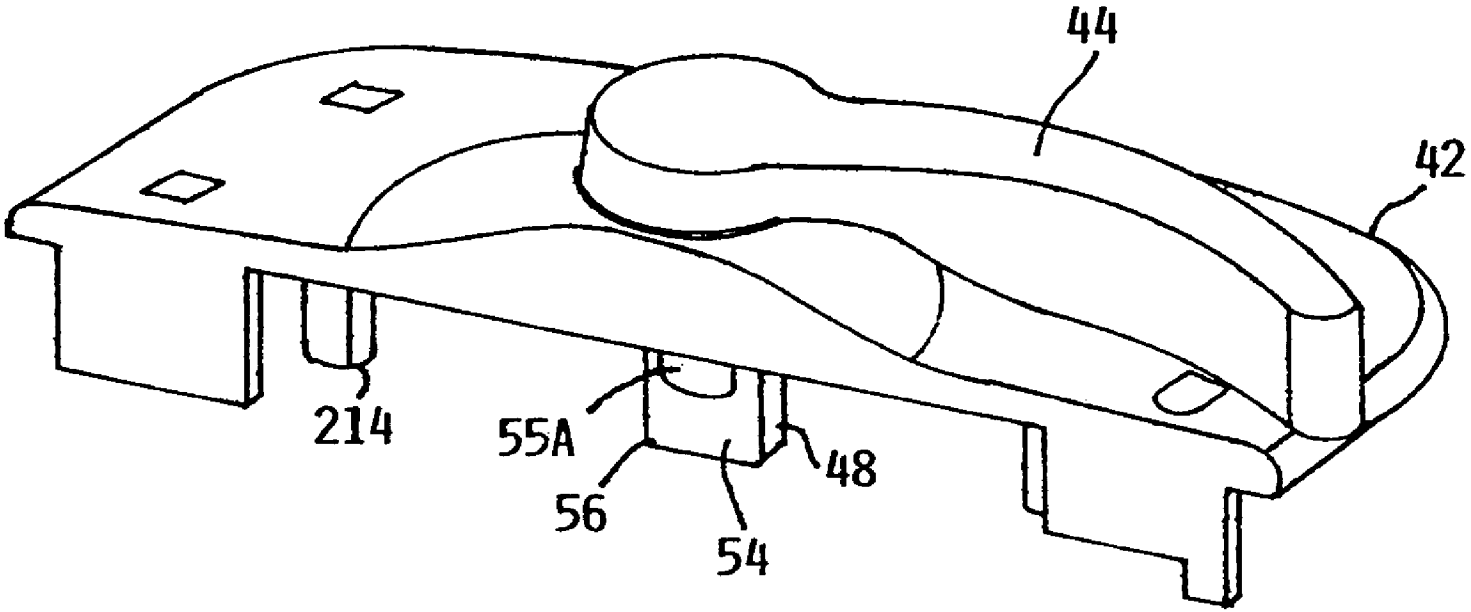
FIG. 19 is an assembled view of the housing cover and control lever depicted in FIG. 18.
Figure 20:
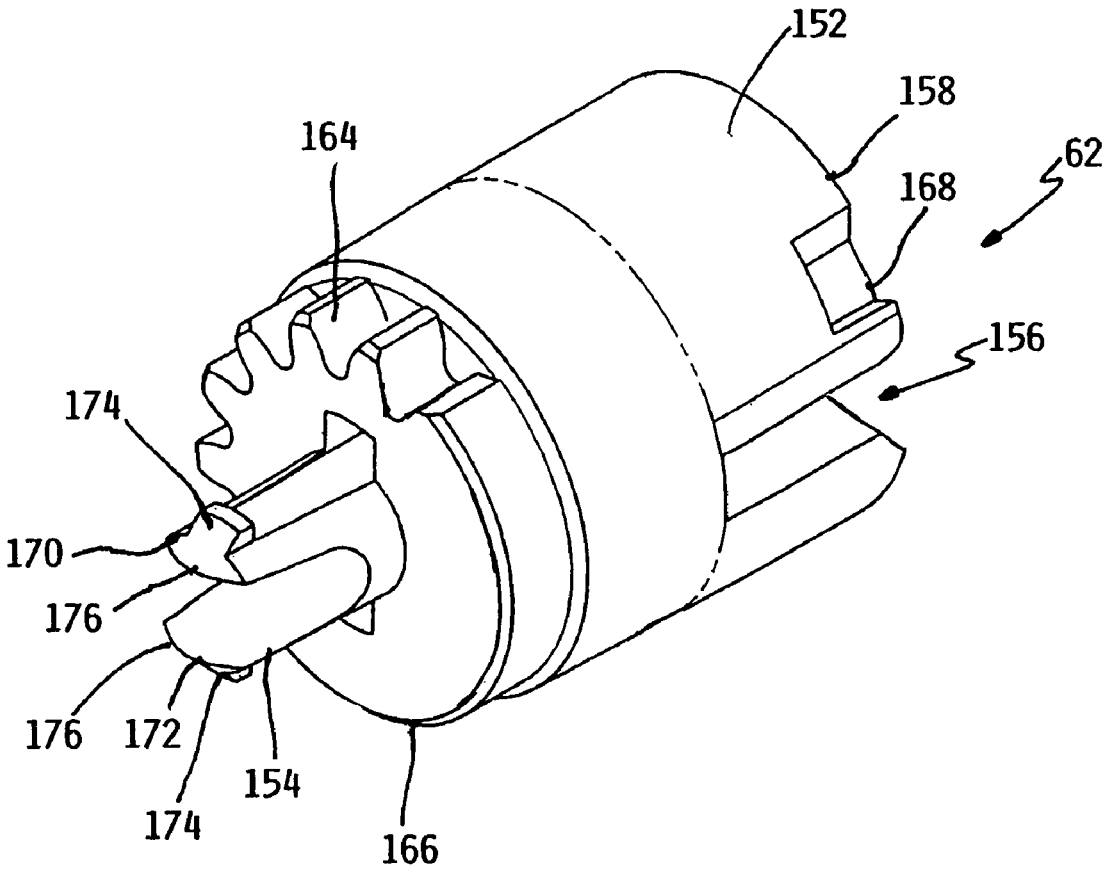
FIG. 20 is a perspective view of the spool of an actuator assembly according to an embodiment of the invention.
Figure 21:
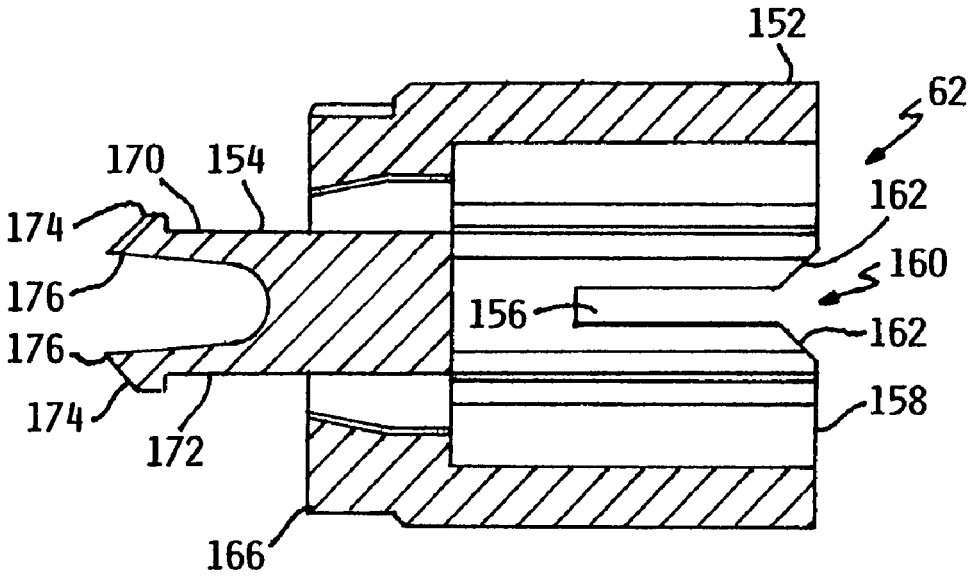
FIG. 21 is a cross-sectional view of the spool depicted in FIG. 20 taken at Section 21-21 of FIG. 22.
Figure 22:
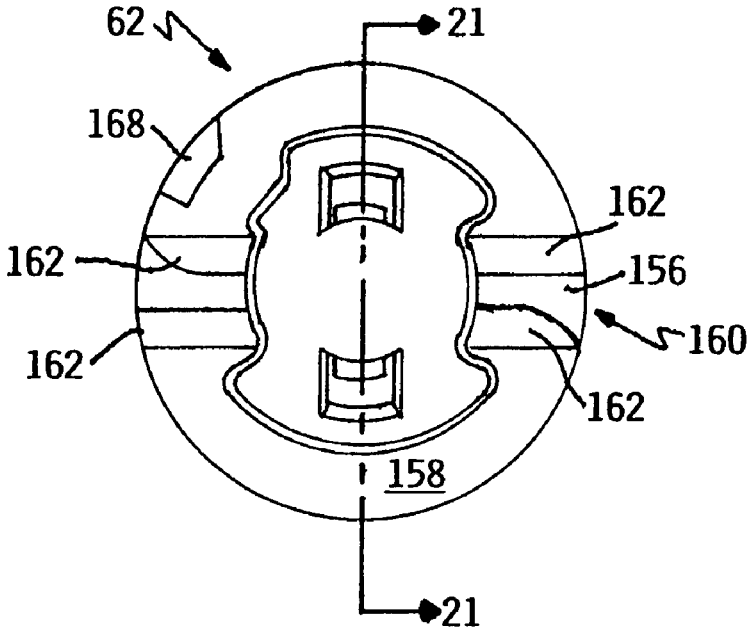
FIG. 22 is a bottom plan view of the spool depicted in FIG. 20.
Figure 23:
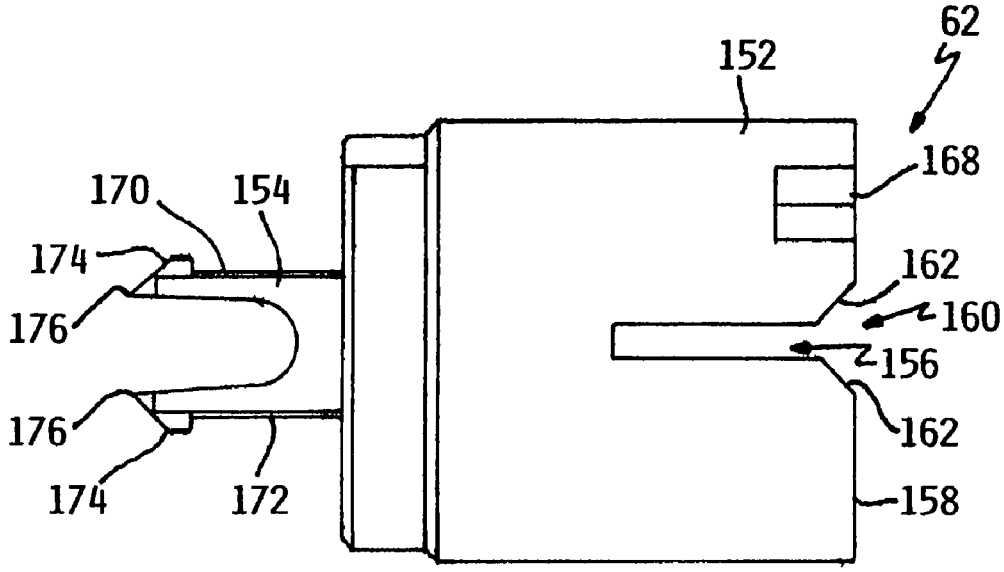
FIG. 23 is a side view of the spool depicted in FIG. 20.
Figure 24:
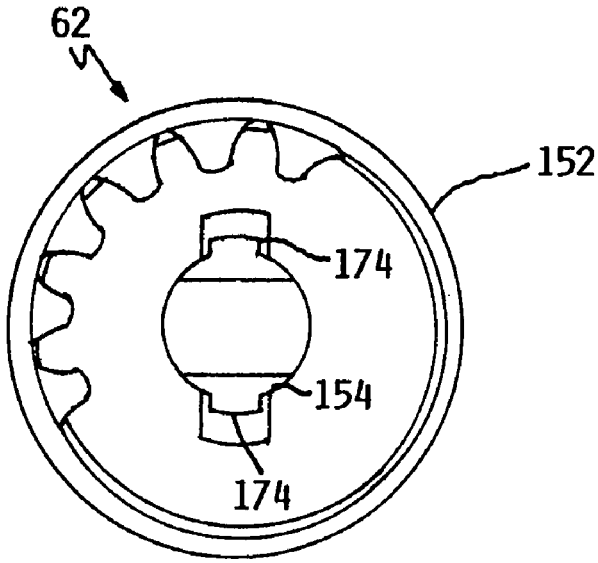
FIG. 24 is a top plan view of the spool depicted in FIG. 20.
Figure 25:
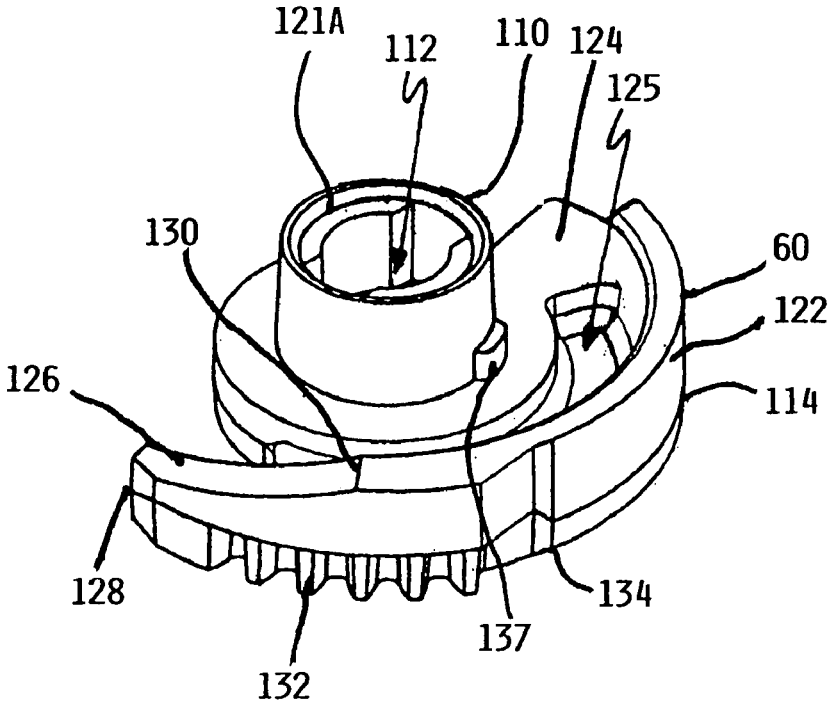
FIG. 25 is a top perspective view of the sweep cam of an actuator assembly according to an embodiment of the invention.
Figure 26:
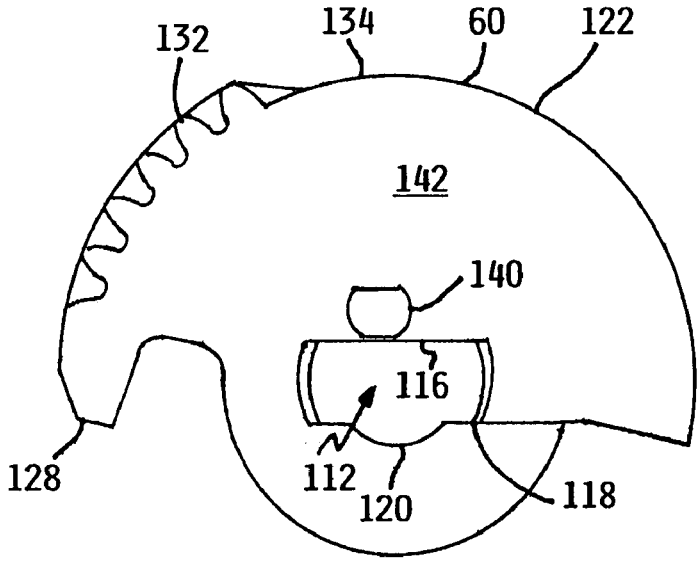
FIG. 26 is a bottom plan view of the sweep cam depicted in FIG. 25.
Figure 27:
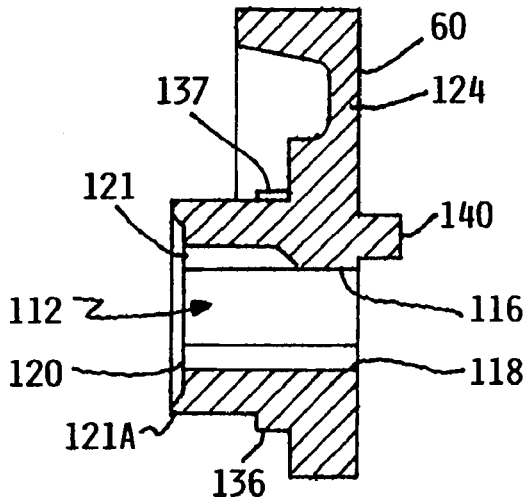
FIG. 27 is a cross-sectional view of sweep cam depicted in FIG. 20 taken at Section 27-27 of FIG. 28.
Figure 28:
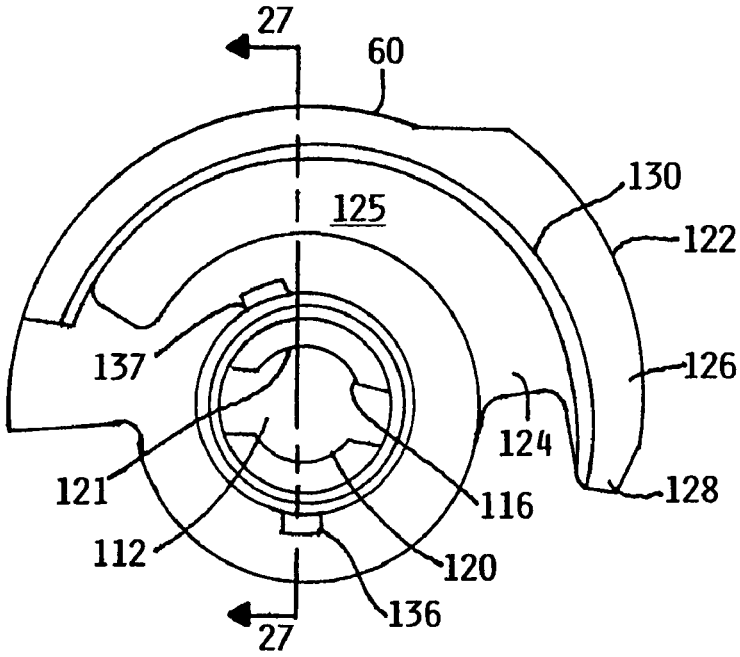
FIG. 28 is a top plan view of the sweep cam depicted in FIG. 25.
Figure 30:
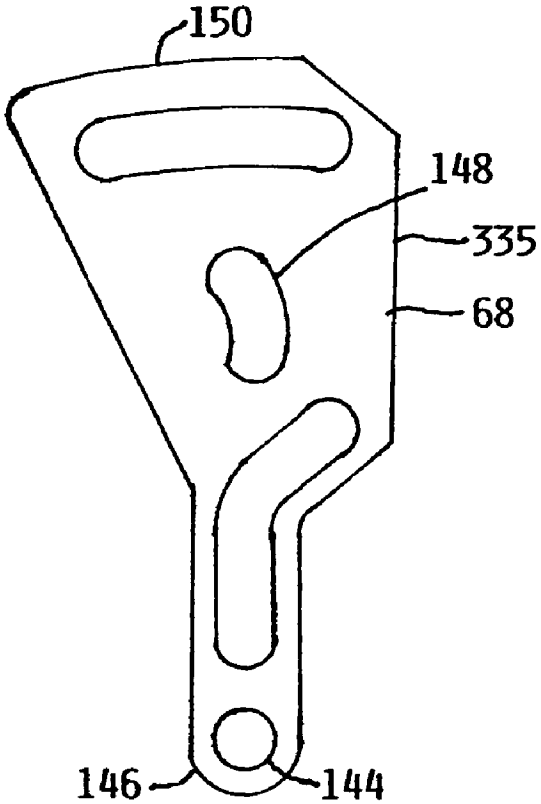
FIG. 30 is a bottom plan view of the pick plate depicted in FIG. 29.
Figure 29:
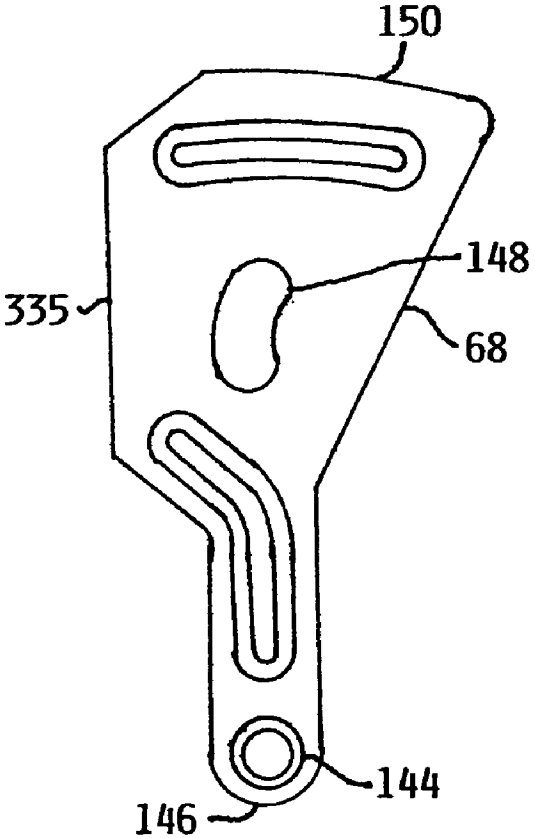
FIG. 29 is a top plan view of the pick plate of an actuator assembly according to an embodiment of the invention.

Housing cover 42 is received on top surface 78 of body 58 with posts 214, 216, received in semicylindrical recesses 188, 190, respectively as depicted in FIGS. 16-17. Outer edges 212 of ears 208, 210, frictionally engage posts 214, 216 to securely retain housing cover 42 on base assembly 40. Guide post 218 is received in aperture 196 to assist with accurate alignment of housing assembly 38 with base assembly 40. Shank 48 extends into opening 112 of sweep cam 60 so that full height protuberance 55 mates with notch 120 and half-height protuberance mates with half-height notch 121, thereby coding lever 44 with sweep cam 60.

Body 58 and spool 62 are desirably made from easily moldable, durable polymer material such as acetal or nylon. Lever 44, housing cover 42, and sweep cam 60, are preferably cast from suitable metallic material such as zinc alloy. Pick plate 68 and housing retainer 66 are preferably die cut from metallic sheet material. Any of the above components, however, may be made from any other suitable material such as polymer or metal. In the depicted embodiments, actuator assembly 32 is easily assembled by mating sweep cam 60 and spool 62 with body 58. Pick plate 68 may then be positioned under tab 109E and aperture 144 pressed down on pivot post 109 to retain sweep cam 60 in place. Lever 44 may likewise be assembled on housing cover 42 by pressing retainer 56 on shank 48 with an arbor press. Housing retainer 66 may be pressed or pushed onto projections 180, 182, and the assembly completed by mating housing cover 42 on body 58 as described above.

As depicted in FIGS. 5-11, each tilt latch assembly 34 generally includes housing 220, plunger 222, primary spring 224, plunger latch 226, latch spring 228, and locking cam 230. Housing 220, generally includes barrel portion 232 and face plate 234. In embodiments of the invention as depicted, for example, in FIGS. 5, 6, 8-11, and 13, housing 220 may be formed in two sections 236, 238, which mate along the longitudinal axis of housing 220. In these embodiments first housing section 236 has projecting hooks 240, which engage shoulder structures 242 of second housing section 238 to secure the two sections 236, 238, together. Second housing section 238 may also have locating pins 244, which are received in recesses 246 to inhibit relative movement between the sections 236, 238.

Plunger 222 generally includes latch bolt portion 248, central body portion 250, and tail portion 252. End 253 of latch bolt portion 248 is tapered from leading edge 253A to shoulder 253B. Channel 254 extends axially from end 256 through tail portion 252. Central body portion 250 defines lock cavity 258 which includes a first portion 260 extending longitudinally within plunger 222, and a second portion 262 extending transversely to first portion 260. Channel 254 continues axially from tail portion 252 through second portion 262 of lock cavity 258, and emerges at outer surface 264 of central body portion 250 proximate shoulder 253B of latch bolt portion 248.

Plunger 222 is received in barrel portion 232 of housing 220 with latch bolt portion 248 extending through conformingly shaped aperture 266 defined by face plate 234. Primary spring 224 is received over tail portion 252 and bears against back wall 268 of housing 220 and central body portion 250 to bias plunger 222 toward face plate 234.

Locking cam 230 generally includes axle portion 270 and radial protrusion 272. End 274 of axle portion 270 has hex socket 276 adapted to receive an Allen wrench of standard dimension. Locking cam 230 is received in lock cavity 258 with axle portion 270 extending axially and rotatable within first portion 260 and radial protrusion 272 within second portion 262. Bore 278 is axially aligned with axle portion 270 and extends from first portion 260 of lock cavity 258 through to front end 280 of central body portion 250 proximate face 282 of latch bolt portion 248. Adjustment latch arm 284 extends rearwardly from front wall 286 of central body portion 250, and includes angled portion 288 which intersects bore 278 and laterally projecting tab 290 at end 292.

Plunger latch 226 has plate portion 294 defining aperture 296 which is conformingly shaped with the cross-section of latch bolt portion 248. Trigger portion 298 extends from plate portion 294 and has bent end portion 300. Plate portion 294 is slidingly received in transverse slot 302 in face plate 234. Latch spring 228 is received in recess 304 and bears against edge 306 of plate portion 294 to bias plunger latch 226 in the direction of trigger portion 298.

In embodiments of the invention housing 220 and plunger 222 of tilt latch assembly 34 are made from low-cost, easily formable acetal polymer material. These components, however, may also be made from any material having sufficient strength and suitable durability characteristics. Primary spring 224, plunger latch 226, latch spring 228, and locking cam 230 are desirably made from metallic material, but may also be made from any other suitable material. In the depicted embodiments, tilt-latch assembly 34 may be easily assembled by first assembling plunger latch 226 and latch spring 228 with separate housing sections 236, 238, and locking cam 230 and primary spring 224 with plunger 222. Plunger 222 may then be placed in one of housing sections 236, 238, and the housing sections snapped together by mating projecting hooks 240 with shoulder structures 242 and locating pins 244 with recesses 246.

Tilt lock latch assembly 30 is received in top rail 308 of inside sash 310 of a double hung sash window 312. Top rail 308 has cavity 314 defined in top surface 316 for receiving base assembly 40 with spool 62 disposed in lower cavity portion 318. Lateral bore 320 extends between side faces 322, 324, of top rail 308 and intersects lower cavity portion 318.

Figure 34:
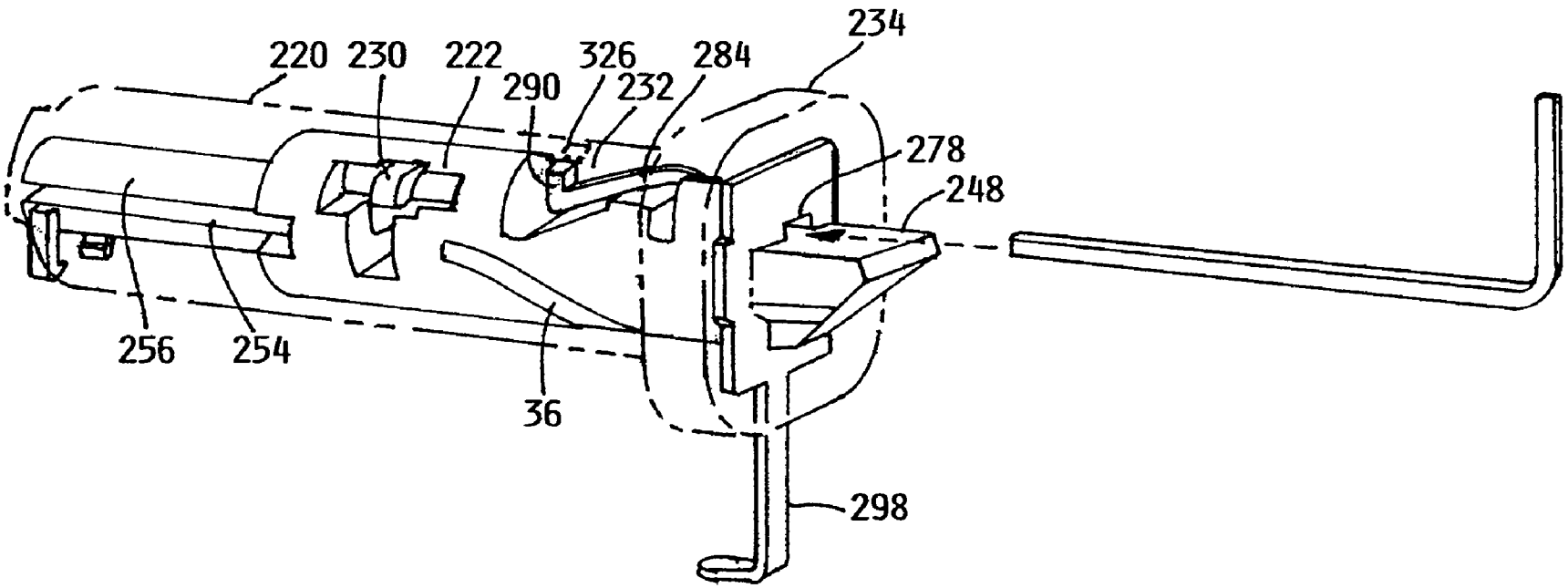
FIG. 34 is a perspective view of a tilt-latch assembly according to an embodiment of the invention with the housing depicted in phantom to reveal structures enabling locking of a linking member from outside the housing with an Allen wrench.
Figure 35:
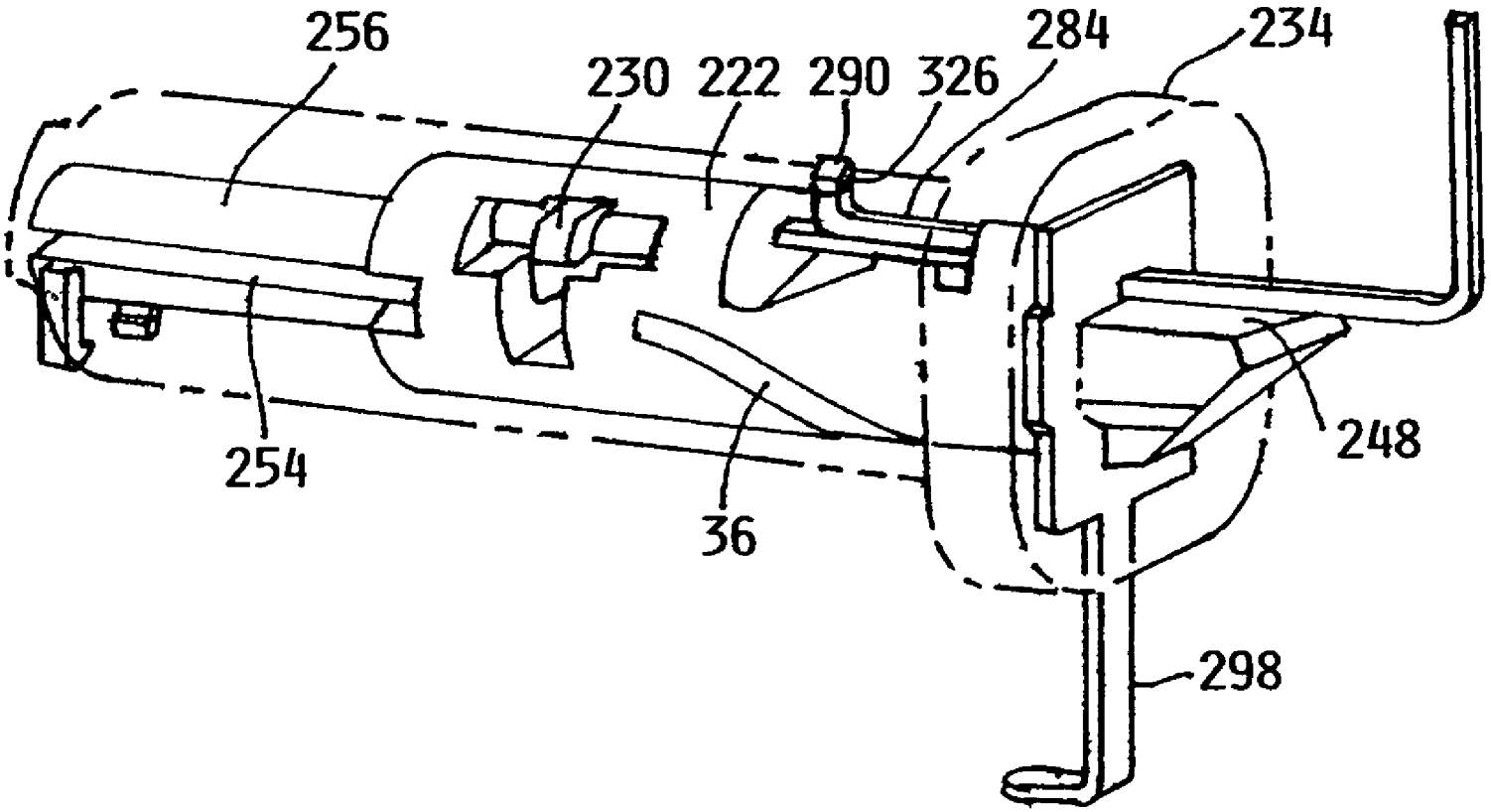
FIG. 35 depicts the tilt-latch assembly of FIG. 34 with the Allen wrench engaged with the locking cam member.
Figure 36:
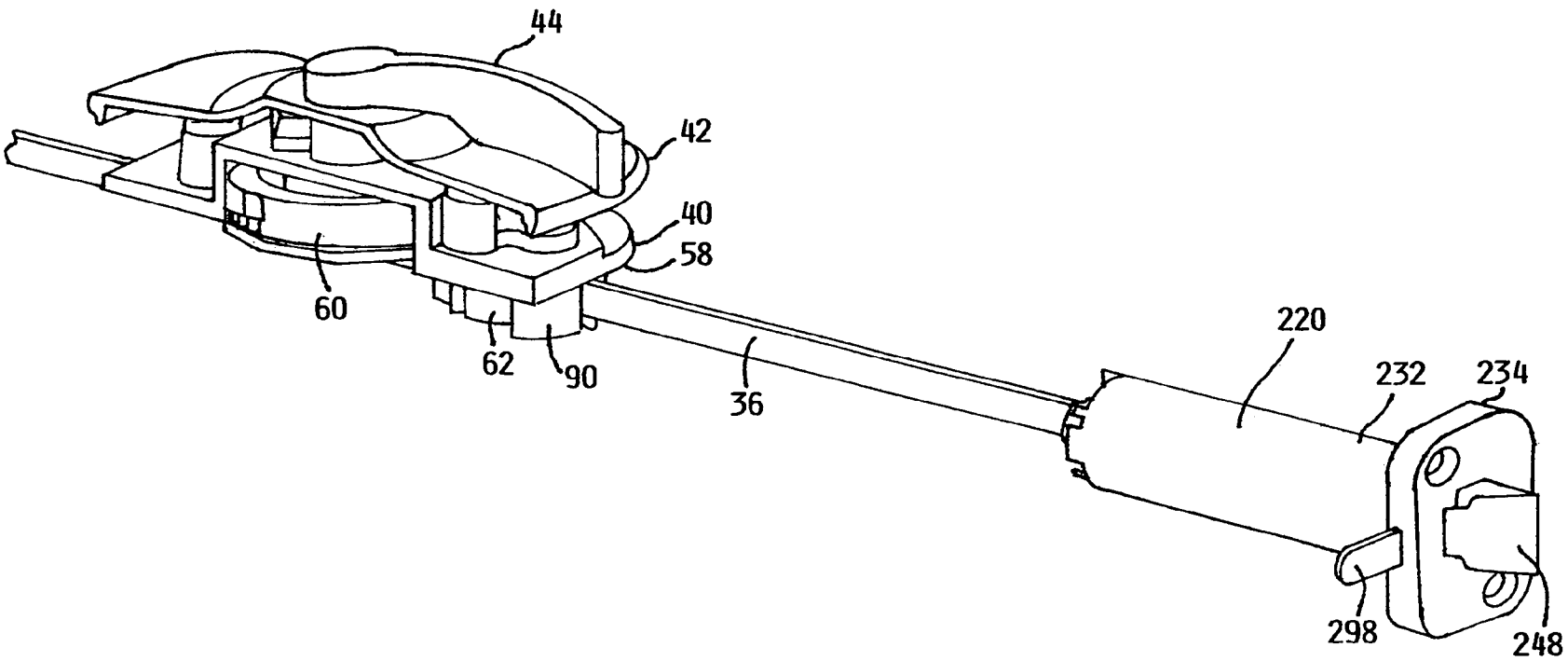
FIG. 36 is a perspective view of an integrated lock and tilt-latch assembly according to the present invention in a "locked" position.
Figure 37:
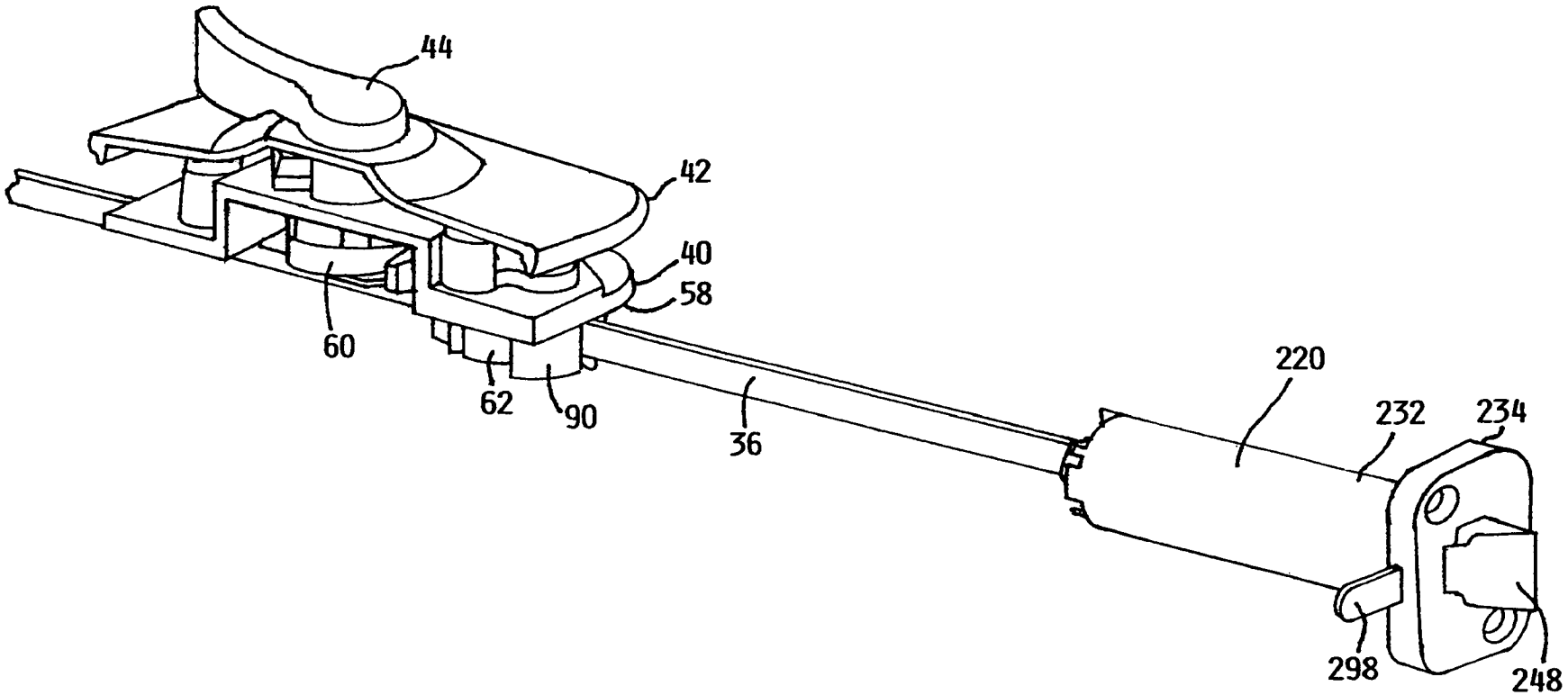
FIG. 37 is a perspective view of an integrated lock and tilt-latch assembly according to the present invention in an "unlocked" position.
Figure 38:
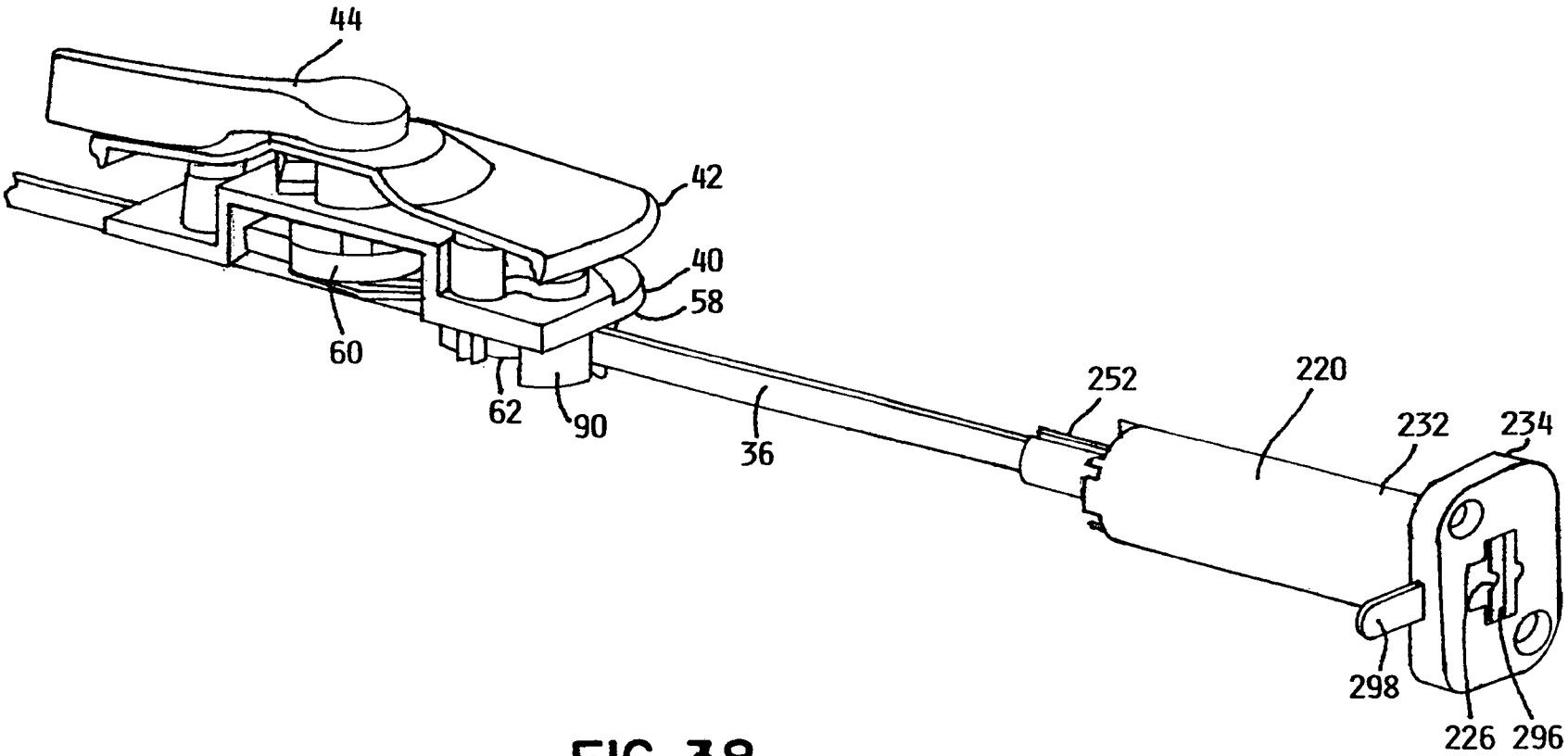
FIG. 38 is a perspective view of an integrated lock and tilt-latch assembly according to the present invention in a "tilt" position.
Figure 42:
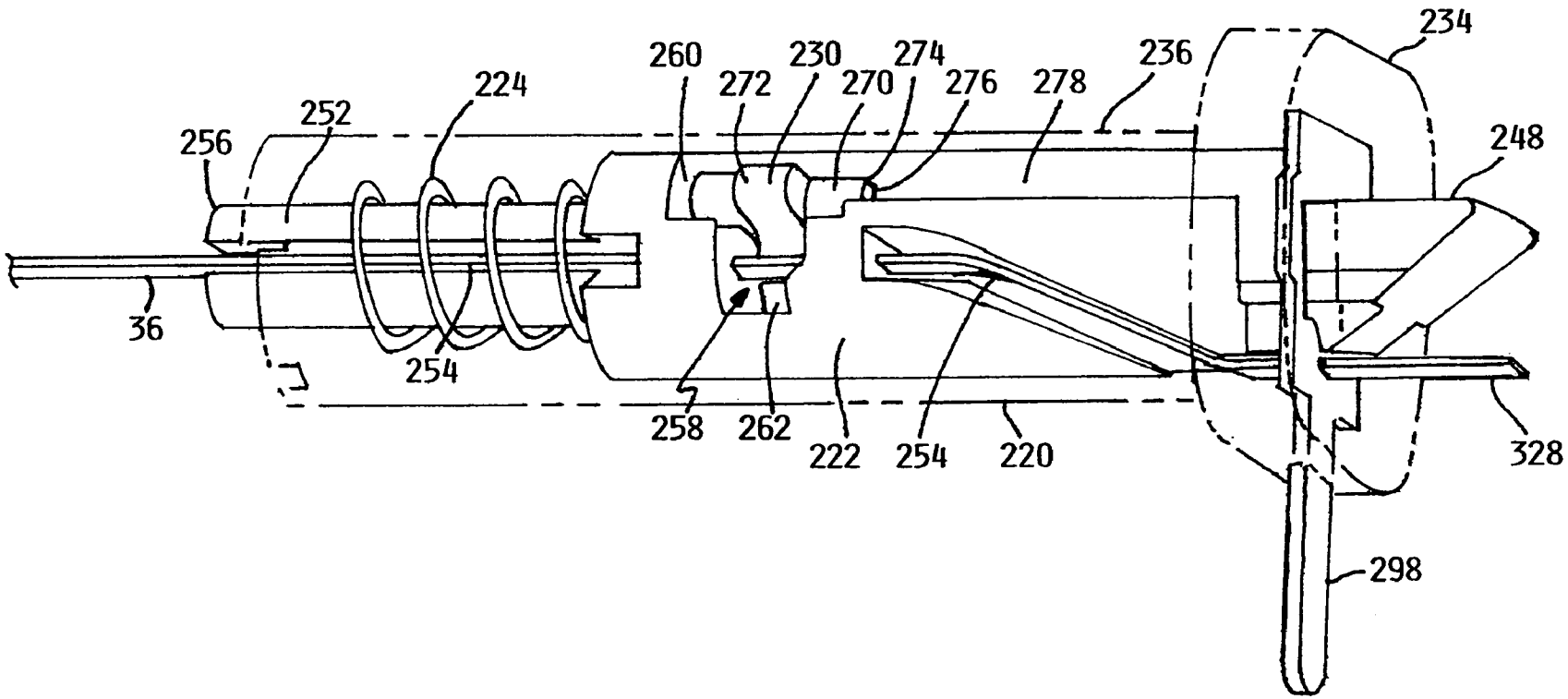
FIG. 42 is a perspective view of a tilt-latch assembly according to an embodiment of the invention with the housing depicted in phantom revealing the linking member passage and locking member prior to locking of the linking member.
Figure 43:
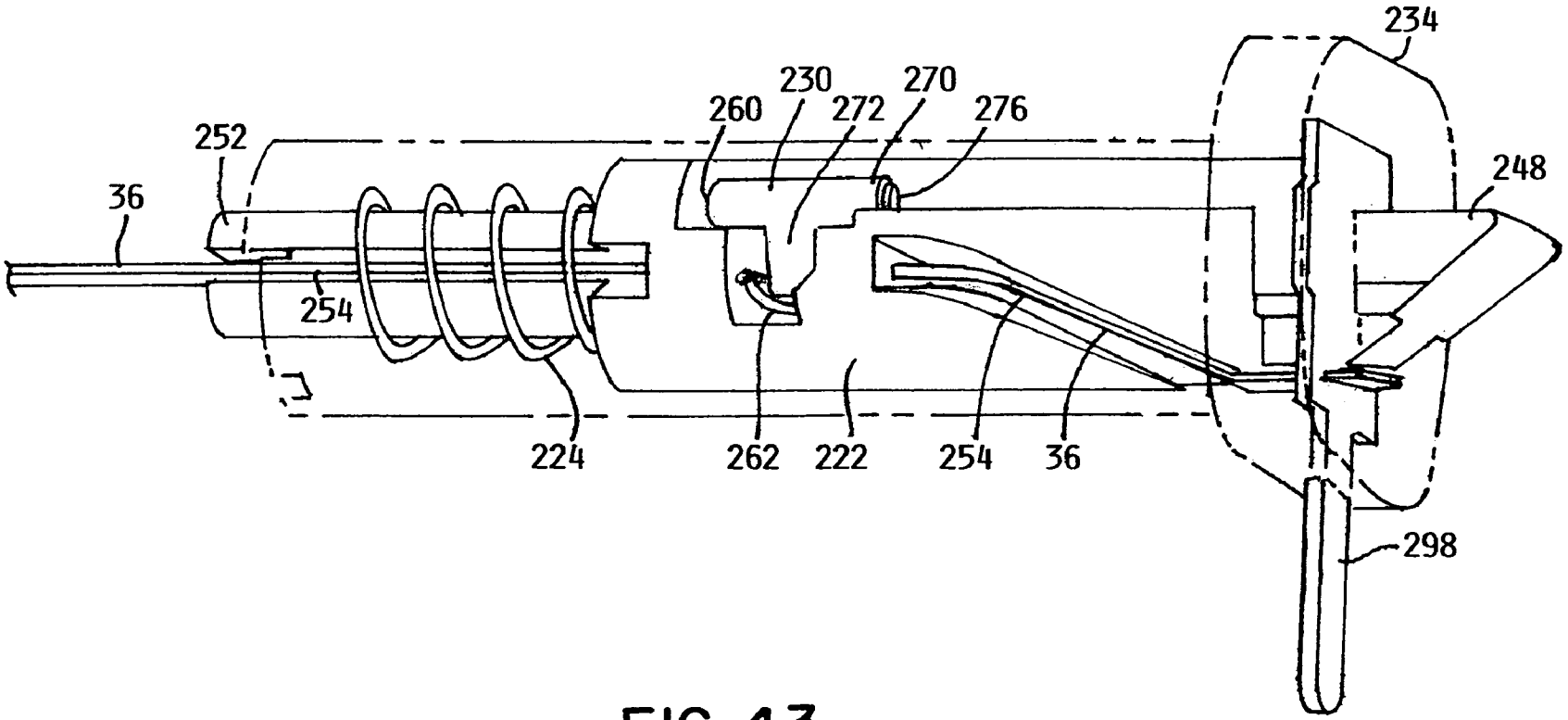
FIG. 43 depicts the tilt-latch assembly of FIG. 42 with the locking cam member positioned to lock the linking member to the plunger.
Figure 44:
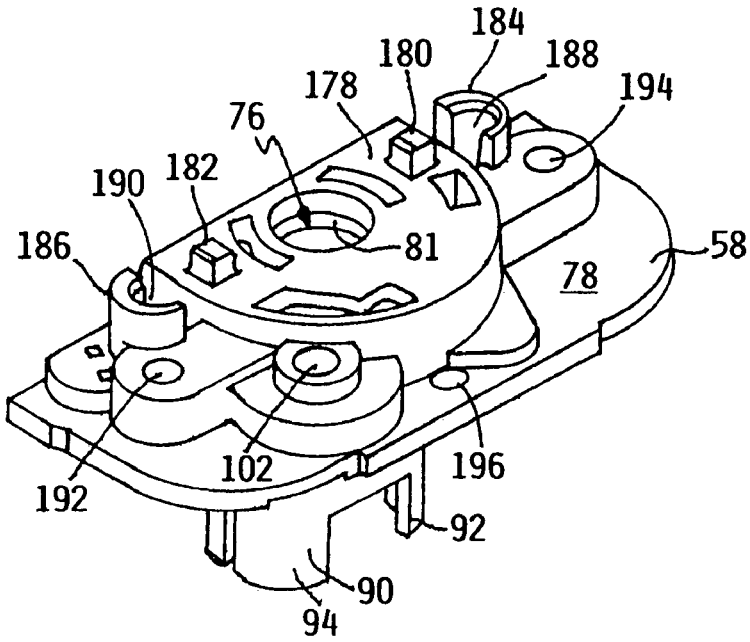
FIG. 44 is a top perspective view of the body of the base assembly of an actuator assembly according to an embodiment of the present invention.
Figure 45:
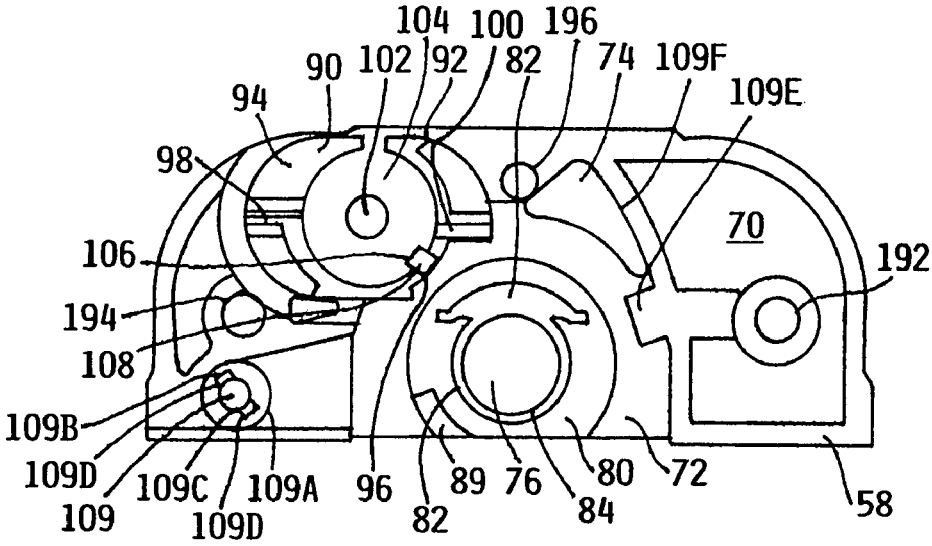
FIG. 45 is a bottom plan view of the body depicted in FIG. 44.
Figure 46:
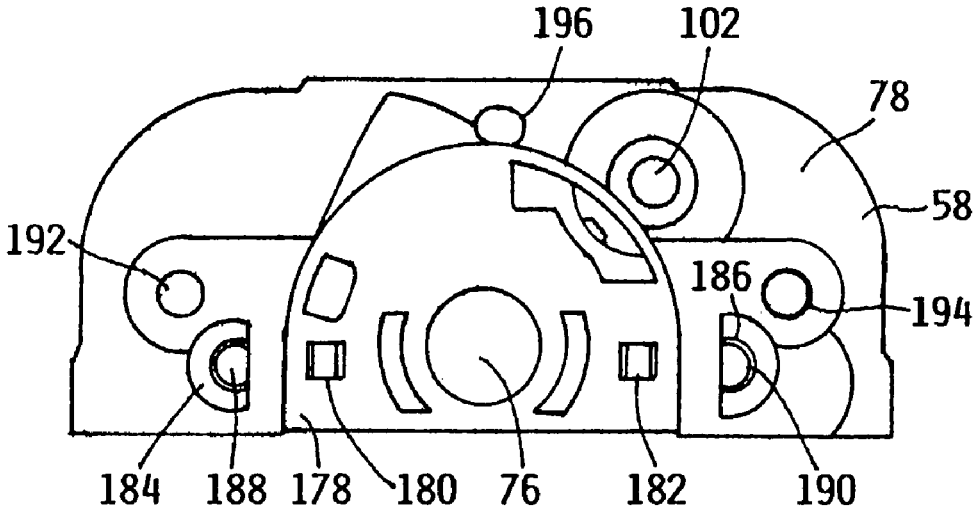
FIG. 46 is a top plan view of the body depicted in FIG. 44.

Tilt lock latch assembly 30 may be assembled by linking each of two tilt latch assemblies 34 disposed in lateral bore 320 of the window 312 with linking member 36, and placing actuator assembly 32 in cavity 314 to engage linking member 36 with spool 62. Linking member 36 is preferably formed from a suitable stretch-resistant flexible polymer material. Linking member 36 is engaged with the first tilt latch assembly by inserting an Allen wrench through bore 278 and engaging hex socket 276 of locking cam 230 as depicted in FIGS. 34-35. As the Allen wrench is inserted, it forces adjustment latch arm 284 outwardly toward barrel portion 232 of housing 220, engaging tab 290 in aperture 326 to lock plunger 222 axially within housing 220 as the adjustment is made. Once engaged in hex socket 276, the Allen wrench is rotated to rotate locking cam 230 so that radial protrusion 272 is clear of channel 254. An end 328 of linking member 36 is then inserted in channel 254 at end 256 and threaded through channel 254 until it extends from housing 220 proximate latch bolt portion 248 as depicted in FIG. 42. The Allen wrench is then rotated in the opposite direction as depicted in FIG. 43 to rotate locking cam 230 so that radial protrusion 272 forces linking member 36 into second portion 262 of lock cavity 258. In this position, linking member 36 is frictionally locked within and secured to plunger 222. The Allen wrench is then withdrawn from bore 278, enabling tab 290 to recede from aperture 326. Excess linking member 36 may then be trimmed off flush with face plate 234.

With the first tilt latch assembly 34 disposed in, and linking member 36 extending through, lateral bore 320 and trigger portion 298 facing outer sash 327, linking member 36 may be engaged with the second tilt latch assembly 34 by the same process as described above. With the second tilt latch assembly 34 disposed in lateral bore 320 with trigger portion 298 facing outer sash 327, and with the Allen wrench inserted in bore 278 of the first tilt latch assembly 34 to prevent its plunger 222 from being retracted, linking member 36 is drawn relatively taut before being locked in place and trimmed. Once linking member 36 is in place and taut, base assembly 40 of actuator assembly 32 may be dropped into cavity 314 so that spool 62 is received in lower cavity portion 318. As spool 62 enters lower cavity portion 318, chamfers 101 and 162 guide linking member 36 into slots 98, 100, in spool housing 90 and slot 156 of spool 62 respectively. Fasteners 328 may then be driven through apertures 192, 194, to secure actuator assembly 32 to top rail 308 and housing assembly 38 engaged with base assembly 40 to complete assembly.

Figure 1:
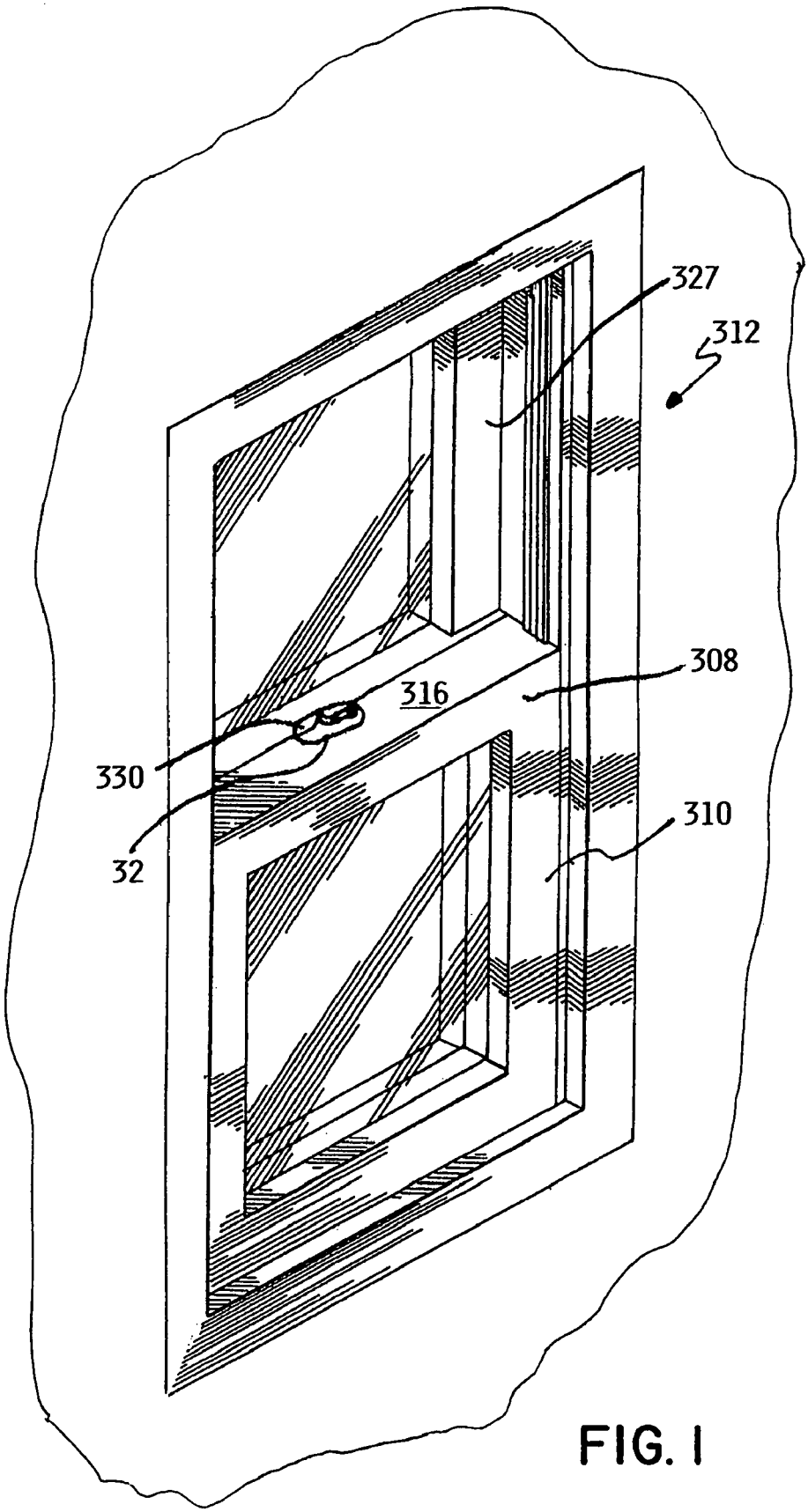
FIG. 1 is a perspective view of a double-hung window with integrated lock and tilt-latch assembly according to an embodiment of the present invention.
Figure 2:
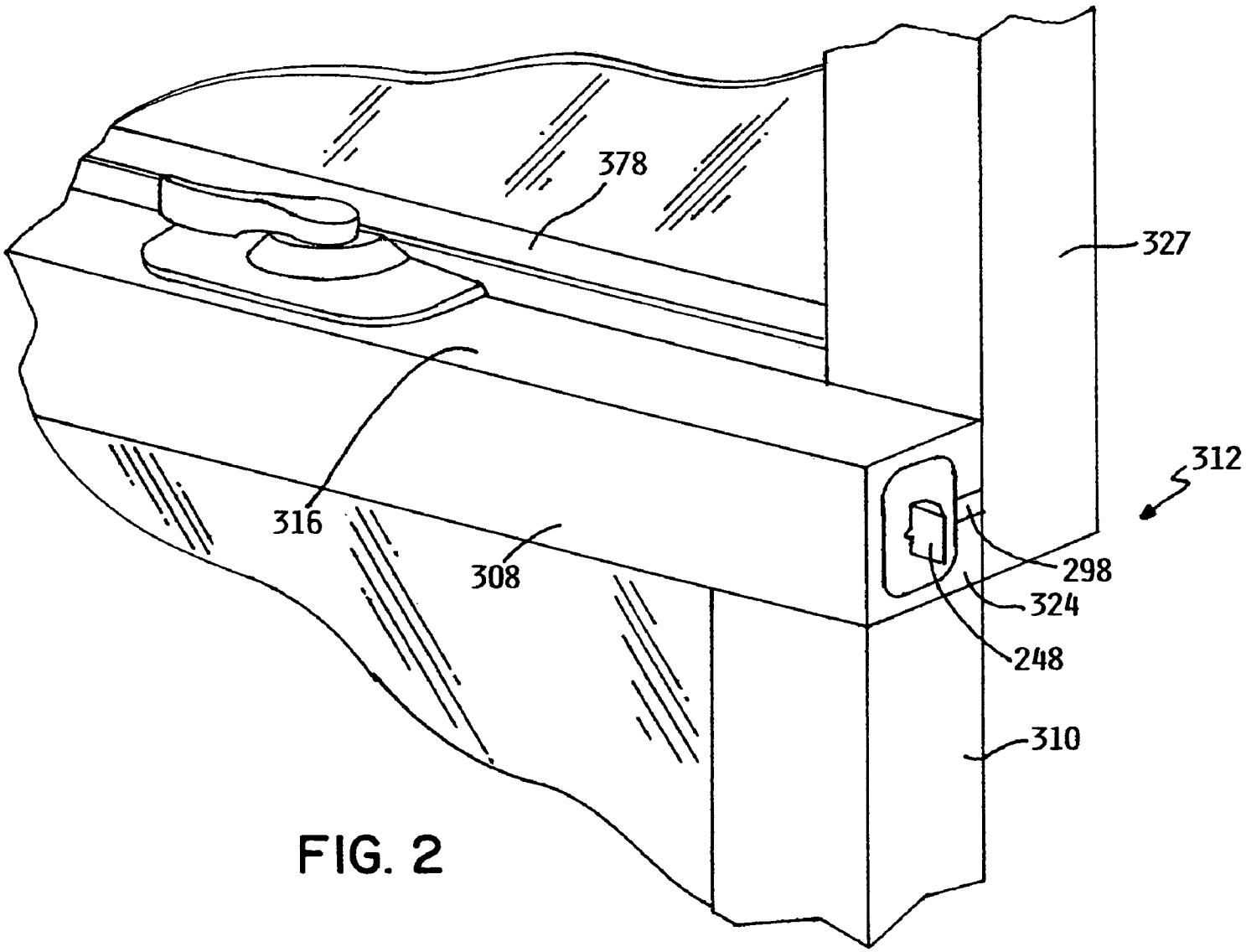
FIG. 2 is a fragmentary perspective view of an inner and outer sash of a double-hung window with integrated lock and tilt-latch assembly according to an embodiment of the present invention.
Figure 3:
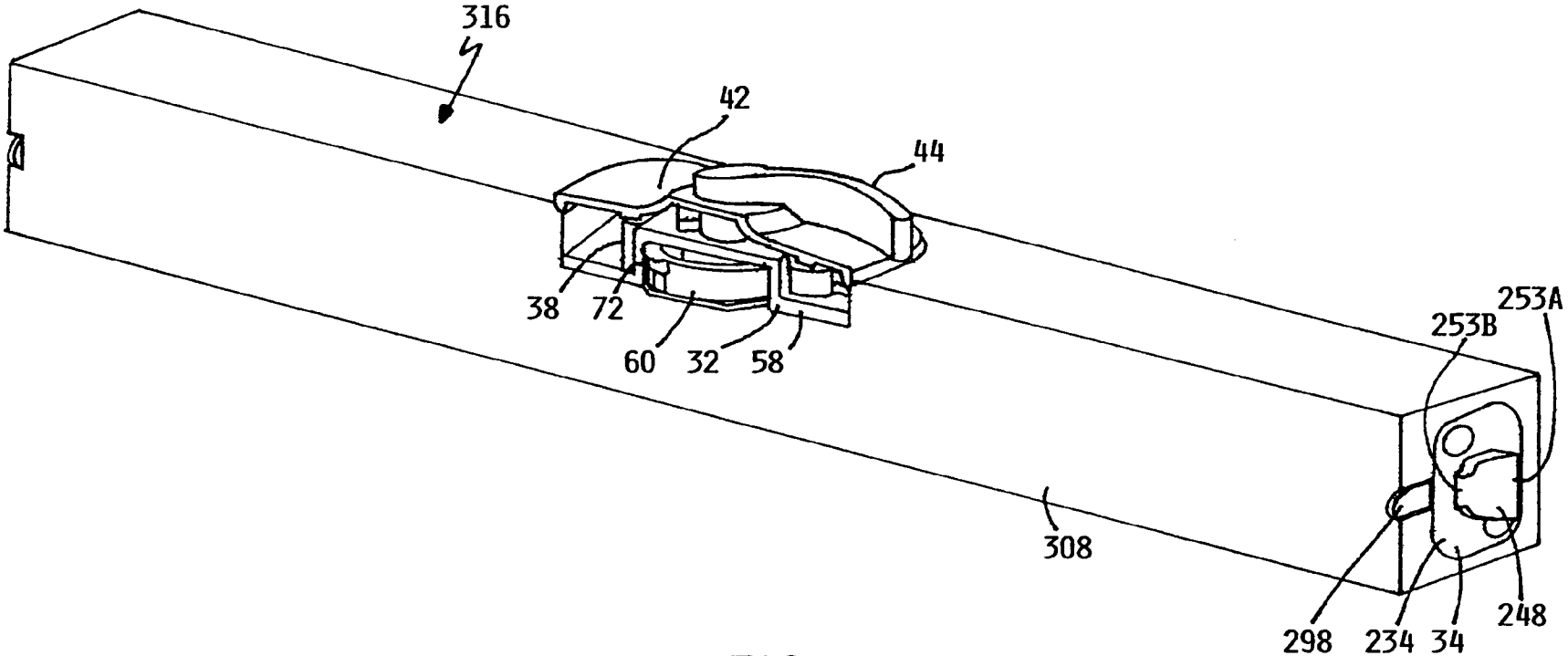
FIG. 3 is a fragmentary perspective view of the top sash rail of a window with integrated lock and tilt-latch assembly according to an embodiment of the present invention.
Figure 39:
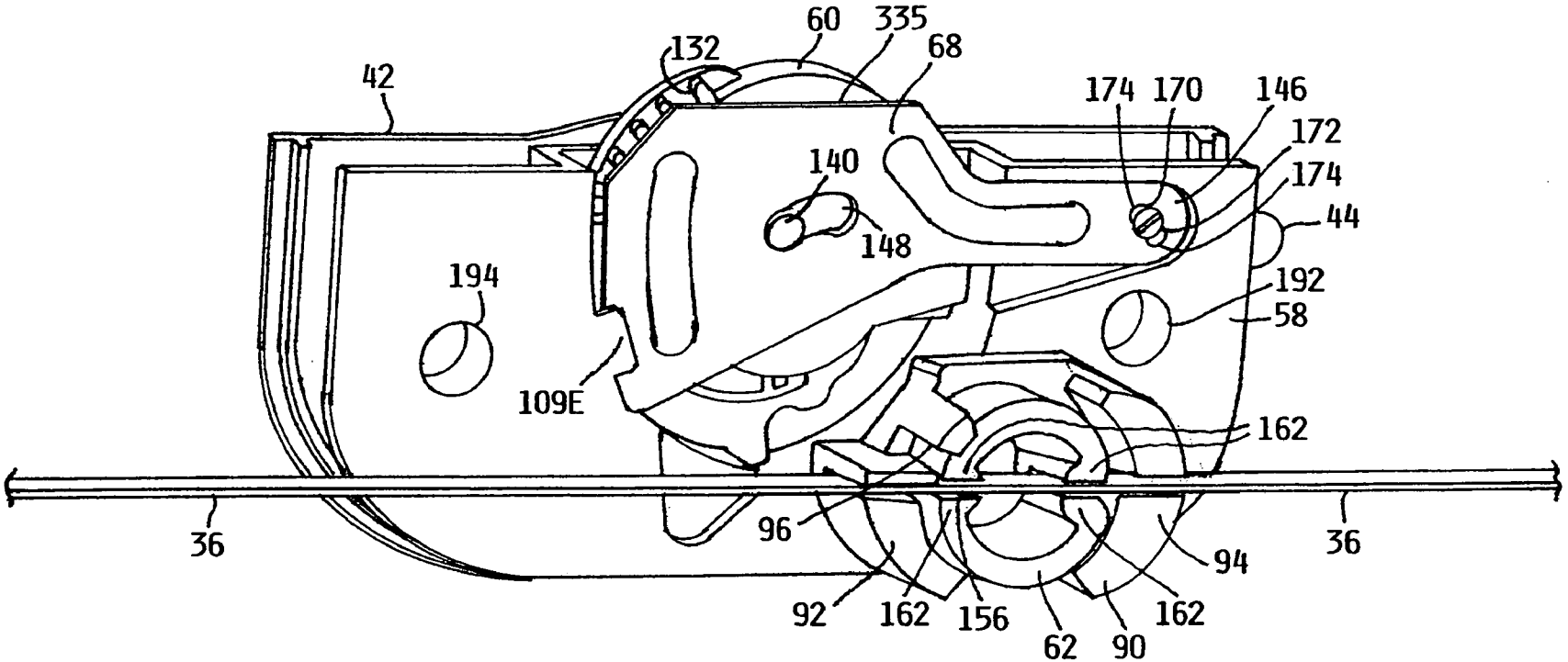
FIG. 39 is a bottom perspective view of the actuator assembly of an integrated lock and tilt-latch assembly according to the present invention in a "locked" position.

In operation, with inside sash 310 and outer sash 327 in a closed position as depicted in FIG. 1, lever 44 may be positioned in a first position as depicted in FIG. 39, wherein outer wall 122 of sweep cam 60 is received in optional keeper 330 or other structure on outer sash 327, thereby locking inside sash 310 and outer sash 327 together. Projection 136 of sweep cam 60 is engaged in bend 88 of detent spring 64 to provide a detent at this "locked" position of lever 44. In this first position, projection 106 of spool detent 96 is engaged in notch 168 of spool 62 and spool 62 remains aligned so that connecting member 36 is not under tension and latch bolt portions 248 of latch bolts 34 project outwardly into grooves 332 in window frame 334, thereby preventing tilting of inside sash 310. Pick plate 68 is positioned with leading edge 335 extending under sweep cam 60 to prevent tampering from outside the window.

Figure 40:
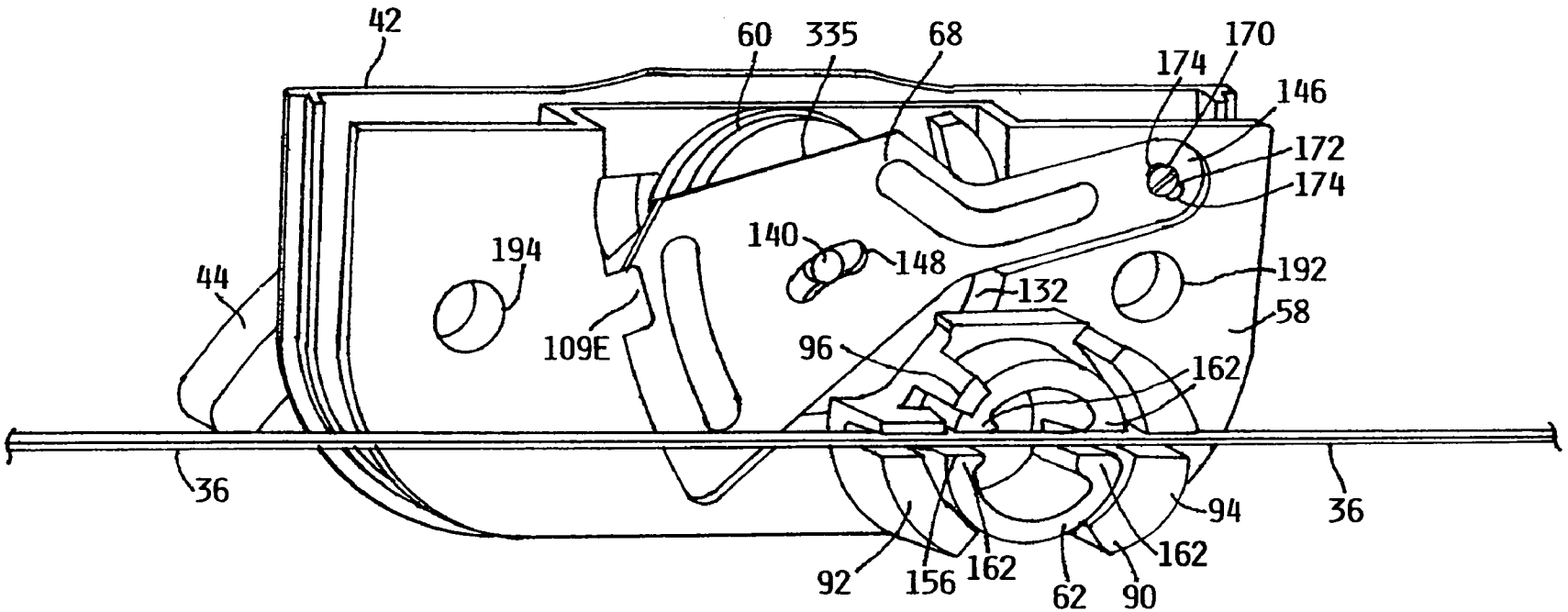
FIG. 40 is a bottom perspective view of the actuator assembly of an integrated lock and tilt-latch assembly according to the present invention in an "unlocked" position.

Window 312 may be unlocked by rotating lever 44 to a second position as depicted in FIG. 40. In this second position, sweep cam 60 is substantially within actuator assembly 32 and does not engage keeper structure 330 so that inside sash 310 and outer sash 327 are free to slide vertically in window frame 334. Projection 137 of sweep cam 60 is engaged in bend 88 of detent spring 64 to provide a detent at this "unlocked" position of lever 44. Once again, latch bolt 34 are not retracted and project outwardly into grooves 332 to prevent tilting of inside sash 310. Projection 106 of spool detent 96 is still engaged in notch 168 of spool 62. As sweep cam 60 rotates from the "locked" to the "unlocked" position, post 140 travels in curved slot 148 of pick plate 68, rotating pick plate 68 inwardly about pivot post 109 so that leading edge 335 clears outer sash 327.

Figure 41:
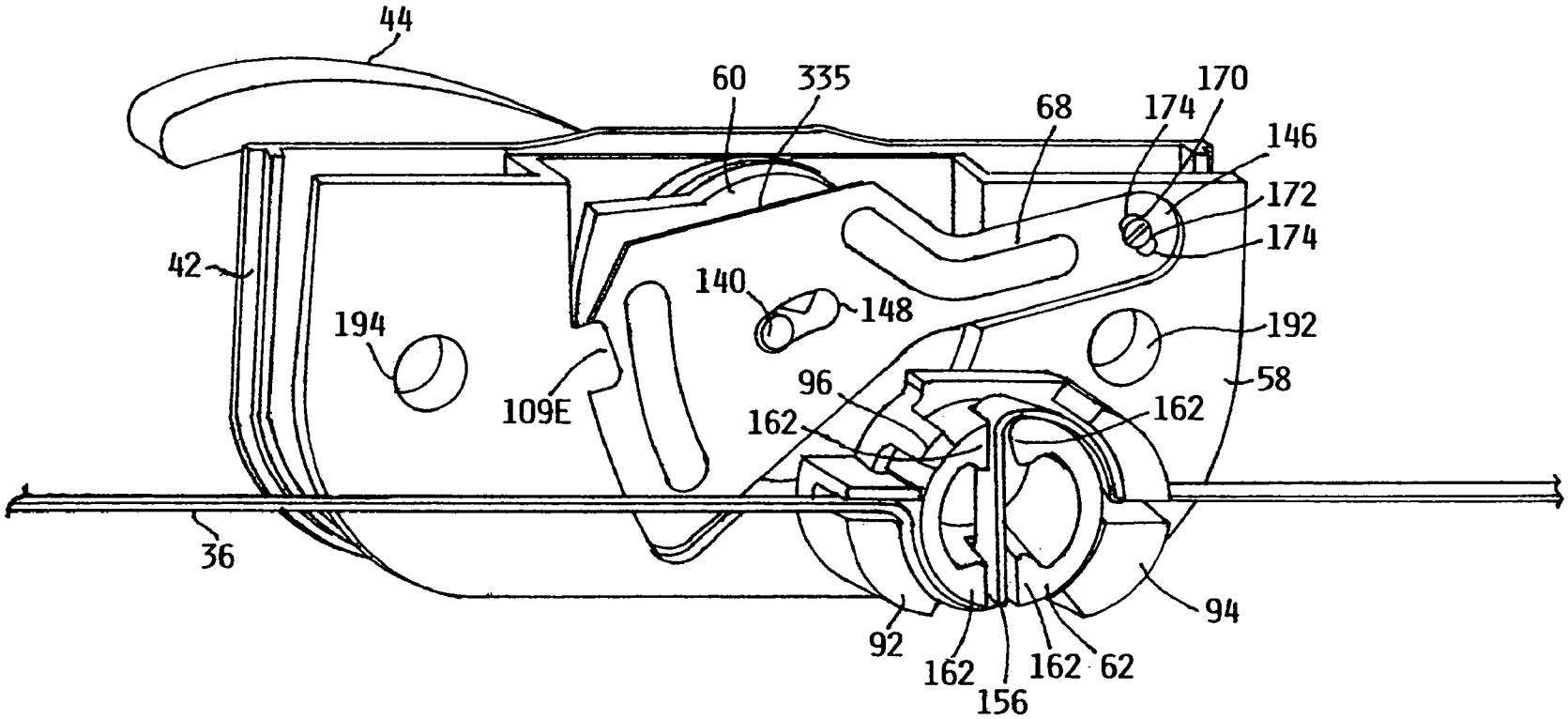
FIG. 41 is a bottom perspective view of the actuator assembly of an integrated lock and tilt-latch assembly according to the present invention in a "tilt" position.

With window 312 unlocked, inside sash 310 may be tilted inward by rotating lever 44 to a third position as depicted in FIG. 41. As lever 44 rotates sweep cam 60, gear segment 132 engages gear sector 164 of spool 62 causing spool 62 to rotate, thereby applying tension to connecting member 36. The tension on connecting member 36 draws plunger 222 of each tilt latch assembly 34 inwardly toward actuator assembly 32, sliding plunger 222 within housing 220 against the bias of primary spring 224 and drawing latch bolt portion 248 within housing 220. As leading edge 253A of latch bolt portion 248 clears plate portion 294 of plunger latch 226, latch spring 228 urges plunger latch 226 in the direction of outer sash 327 so that plate portion 294 partially blocks aperture 266. Leading edge 253A of latch bolt portion 248 engages plate portion 294, holding plunger 222 retracted within housing 220. Trigger portion 298 projects slightly from the outer face 336 of top rail 308. With lever 44 and tilt latches 34 in this "retracted" position, inside sash 310 may be tilted inwardly to gain access to the outside of the window. No detent or spring biasing of lever 44 is provided in the "retracted" position, and lever 44 may be freely rotated back to the "unlocked" position detent, or may remain at any angular position between the "unlocked" position detent and the "stop" position where sweep cam 60 contacts stop 89.

Once the window cleaning or other operation is completed and it is desired to return inside sash 310 to its operable position, inside sash 310 may be simply tilted back into position. Trigger portion 298 contacts outer sash 327, urging plunger latch 226 against the bias of latch spring 228. When plunger latch 226 clears leading edge 253A of latch bolt portion 248, primary spring 224 urges plunger 222 in the direction away from actuator assembly 32, so that latch bolt portion 248 extends outwardly through aperture 266 and engages in grooves 332.

Figure 31:
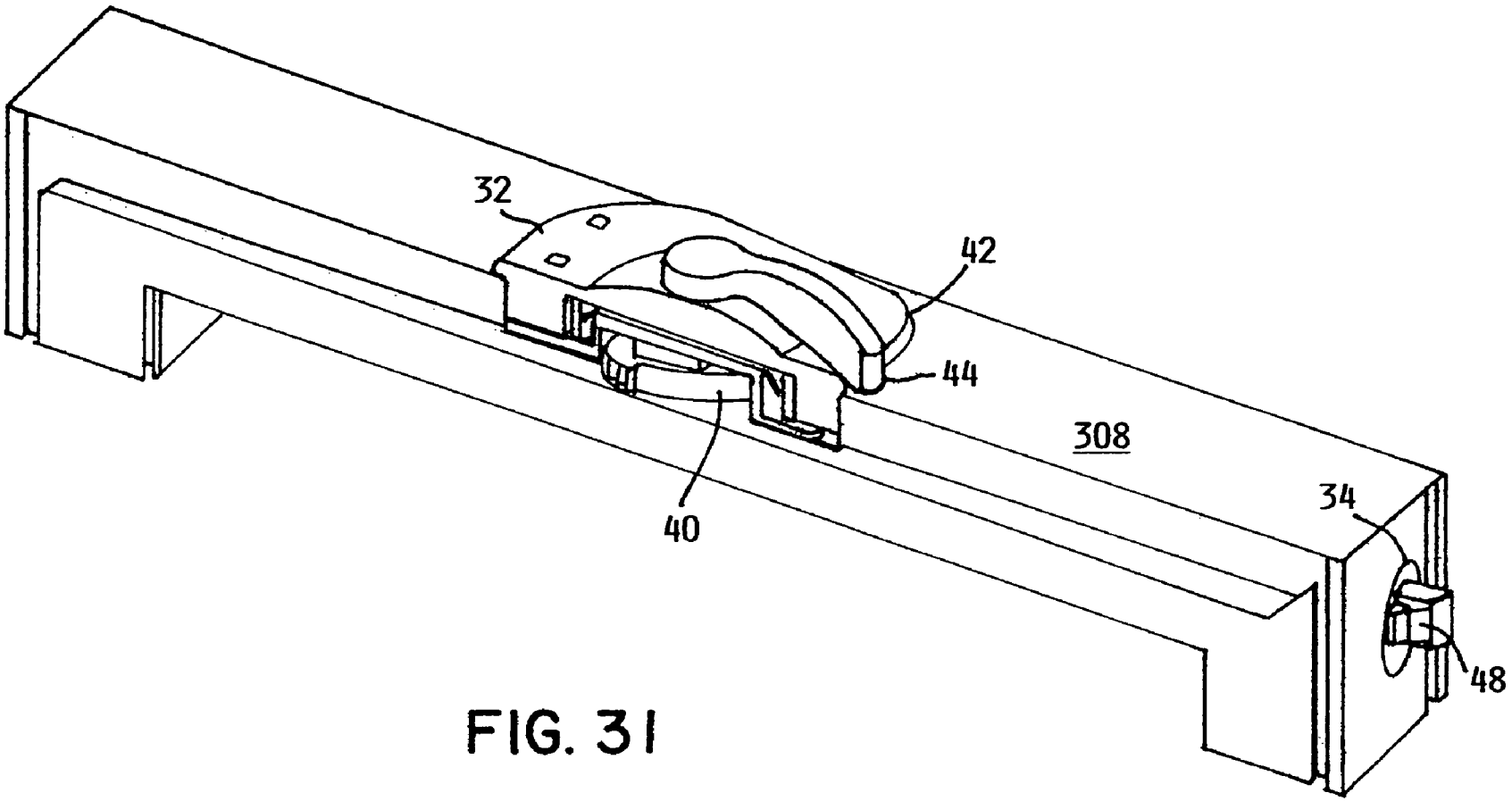
FIG. 31 is a fragmentary perspective view of the top sash rail of a window with integrated lock and tilt-latch assembly according to an alternative embodiment of the present invention.
Figure 32:
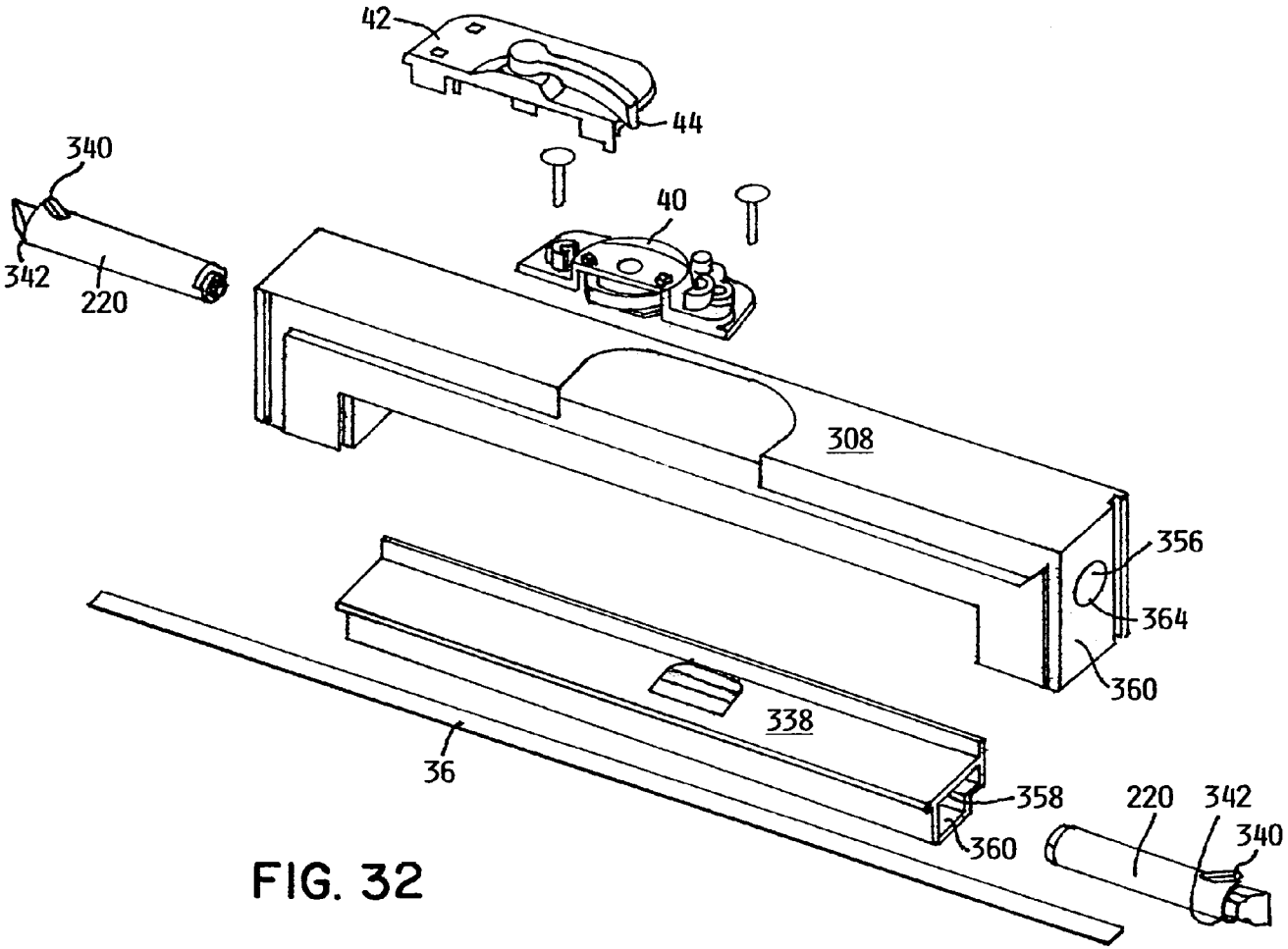
FIG. 32 is an exploded view of the top sash rail of a window with integrated lock and tilt-latch assembly depicted in FIG. 31.
Figure 33:
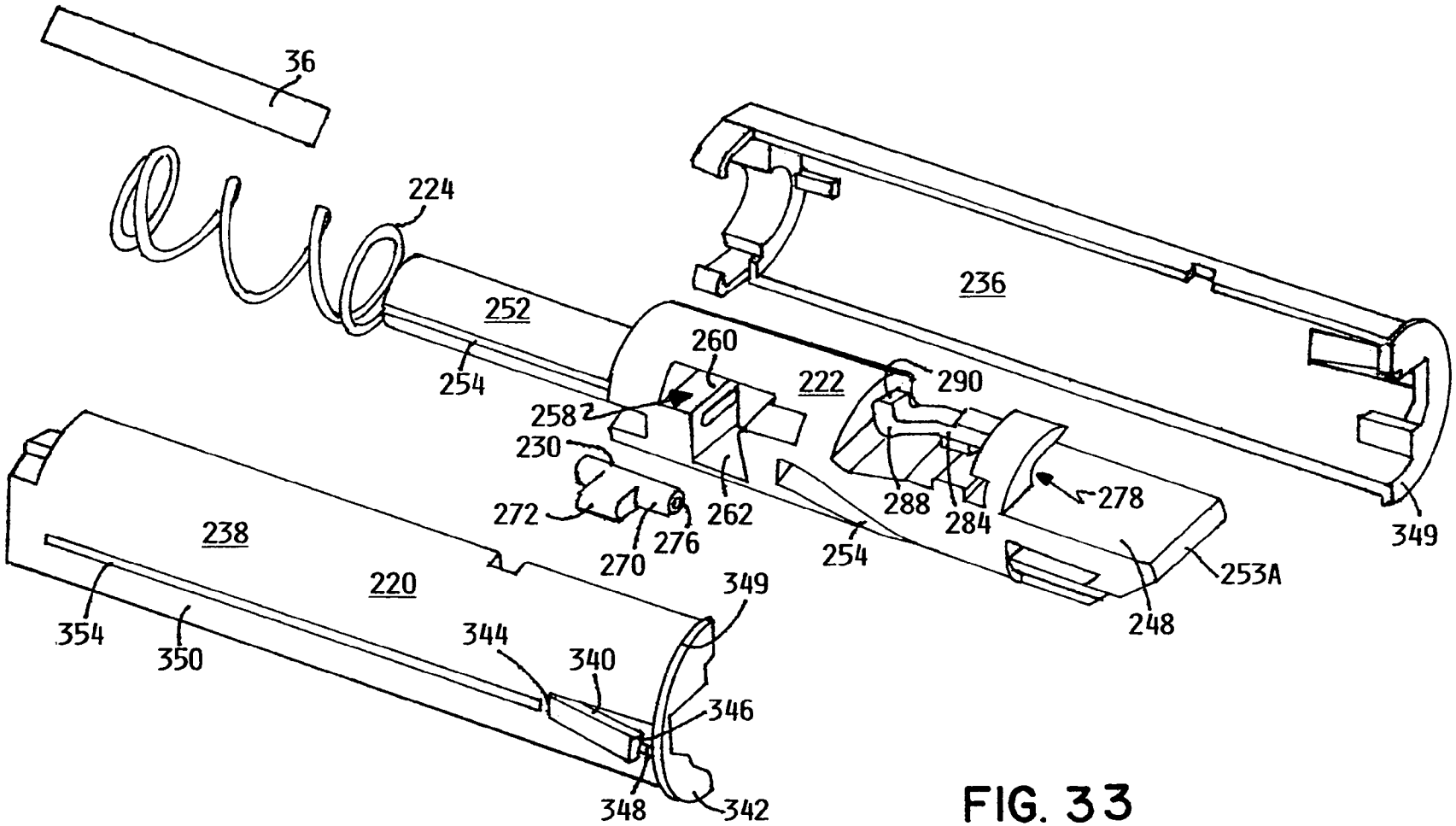
FIG. 33 is an exploded view of the tilt-latch portion of the integrated lock and tilt-latch assembly depicted in FIGS. 31 and 32.

In an alternative embodiment of the invention depicted in FIGS. 31-33, top rail 308 is substantially hollow as is typically the case in vinyl window construction. Reinforcing insert 338 fits inside hollow top rail 308 to provide support for the tilt-latch assemblies 34. Housing 220 of each tilt-latch assembly 34 has spring securing tabs 340 projecting on opposite sides proximate outer end 342. Each tab 340 is resiliently attached to housing 220 at hinge line 344. Outer end 346 is normally spaced apart from housing 220, but is capable of being pressed inwardly into opening 348 in barrel portion 232 Lip 349 extends outwardly around perimeter 349A of end wall 349B. Housing 220 further has opposing flats 350, 352. Flat 350 has longitudinal ridge 354 defined thereon.

Tilt-latch assembly 34 is received through apertures 356 in top rail 308 and inside reinforcing insert 338. Insert 338 is preferably made from metal, but may also be made from any other suitably rigid and durable material. Flats 350, 352, mate with inside walls 358, 360, of reinforcing insert 338 respectively to inhibit undesired rotation of tilt-latch assembly 34 about its longitudinal axis. Longitudinal ridge 354 mates with corresponding groove 362 in inside wall 358 so that tilt-latch assembly 34 is coded for proper orientation. As each tilt-latch assembly 34 is advanced into aperture 356, tab 340 contacts edge 364, forcing outer end 346 inwardly. Once outer end 346 clears edge 364 and lip 349 contacts outer surface 366 of top rail 308, outer end 346 springs outwardly to engage inner surface (not depicted) of top rail 308 to retain tilt-latch assembly 34 in place.

Figure 47:
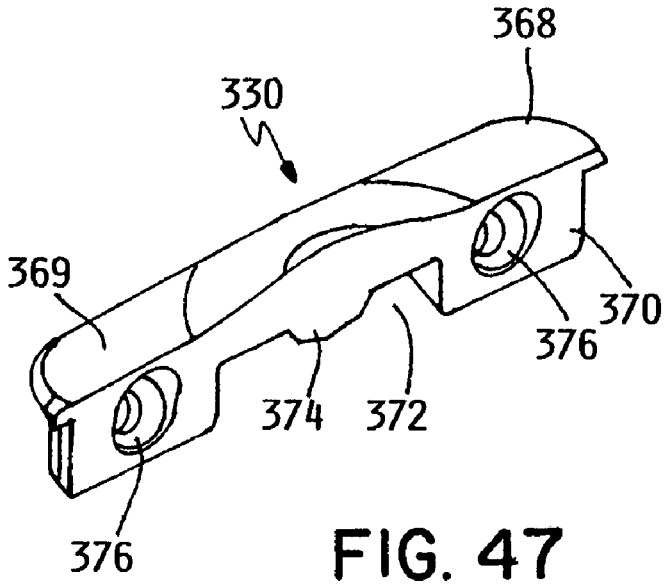
FIG. 47 is a perspective view of a keeper according to an embodiment of the present invention.
Figure 48:
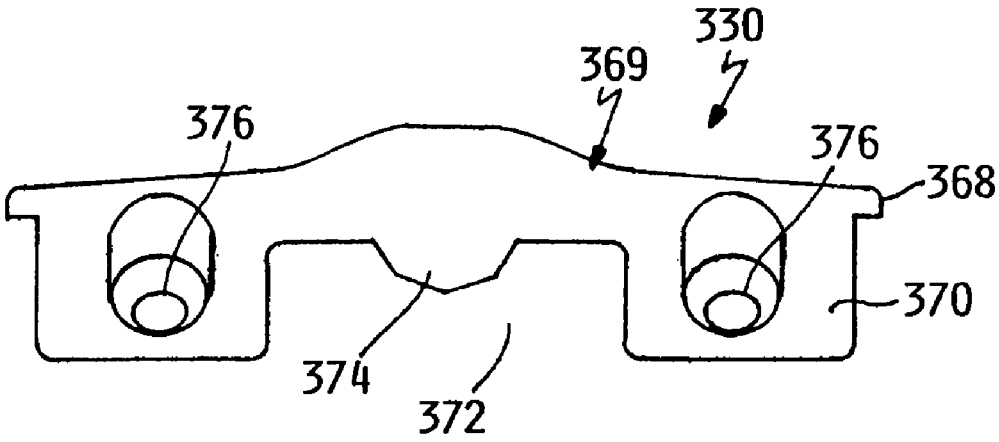
FIG. 48 is a rear elevation view of the keeper depicted in FIG. 47.
Figure 49:
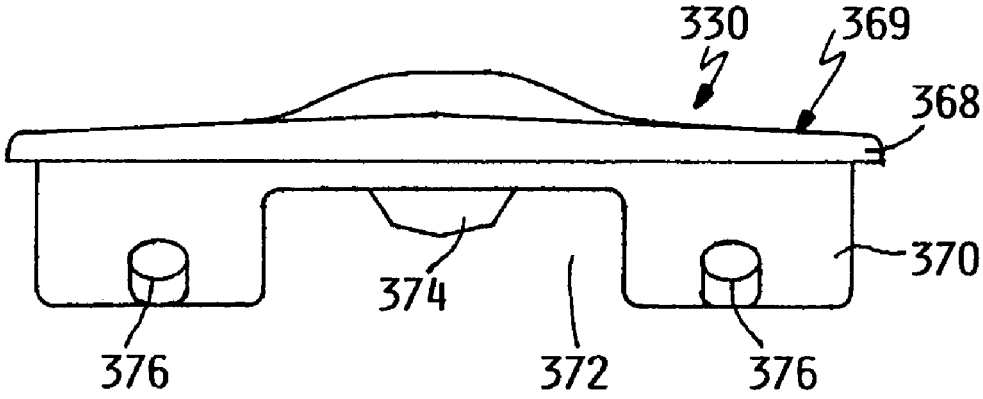
FIG. 49 is a front elevator view the keeper depicted in FIG. 47.

As depicted in FIGS. 47-49, optional keeper 330 generally includes flange portion 368 defining a finished outer surface 369 and skirt portion 370. Skirt portion 370 defines recess 372 for receiving outer wall 122 of sweep cam 60. Projection 374 engages in circumferential recess 125 of sweep cam 60 when sweep cam 60 is rotated to the "locked" position. Openings 376 may be defined in skirt portion 370 for receiving fasteners (not depicted) to secure keeper 330 to bottom rail 378 of outer sash 327 at a location adjacent actuator assembly 32 when bottom rail 378 is adjacent top rail 308 of inside sash 310.

What is claimed is:

1. An integrated lock and tilt-latch mechanism for a sliding window, the window including a frame with at least one sliding sash therein, the sash also tiltably positionable relative to the frame, the mechanism comprising: at least one tilt-latch mechanism adapted for mounting on the sash and including: a housing presenting a longitudinal axis and having an aperture defined in a first end thereof; a plunger having a latch bolt portion; a plunger latch member; and first and second biasing members, the plunger disposed in the housing and selectively slidably shiftable along the longitudinal axis between an extended position in which the latch bolt portion of the plunger projects through the aperture in the housing and a retracted position in which the latch bolt portion of the plunger is substantially within the housing, the first biasing member arranged so as to bias the plunger toward the extended position, the plunger latch member operably coupled with the housing and arranged so as to be selectively slidably shiftable in a direction of travel transverse to the longitudinal axis when the plunger is in the retracted position, the plunger latch member shiftable between a first position in which the plunger latch member at least partially blocks the aperture of the housing to prevent shifting of the plunger and a second position in which the plunger latch member enables shifting of the plunger, the second biasing member arranged so as to bias the plunger latch member toward the first position; an actuator mechanism adapted for mounting on the sash and including a housing, a control on the housing of the actuator mechanism, a lock member, and a tilt-latch actuator member, the lock member and the tilt-latch actuator member operably coupled with the control; and, a linking member operably coupling the tilt-latch actuator member and the plunger of the at least one tilt-latch mechanism, the control selectively positionable among at least three positions including a locked position in which the lock member is positioned so that a portion of the lock member extends from the housing of the actuator mechanism, an unlocked position in which the lock member is positioned substantially within the housing of the actuator mechanism, and a tilt position in which the lock member is positioned substantially within the housing of the actuator mechanism and the plunger of the tilt-latch mechanism is positioned in the retracted position, wherein the linking member is flexible, and wherein the plunger defines a channel for receiving the linking member, the plunger further comprising a locking member positioned proximate the channel, the locking member selectively shiftably adjustable from a location outside the housing of the tilt-latch mechanism between a first position in which the linking member is freely slidable in the channel to enable insertion and removal of the linking member, and a second position in which the locking member is engaged with the linking member to fixedly secure the linking member in the channel.

2. The mechanism of claim 1, wherein the lock member comprises a sweep cam.

3. The mechanism of claim 1, wherein the control comprises a rotatable lever.

4. The mechanism of claim 1, further comprising a keeper for receiving the lock member when the control is positioned in the locked position.

5. The mechanism of claim 1, further comprising a second tilt-latch mechanism.

6. The mechanism of claim 5, wherein the linking member is a continuous strip of polymer material extending between the tilt-latch mechanisms, wherein the actuator mechanism is positioned intermediate the tilt-latch mechanisms, and wherein the tilt-latch actuator comprises a rotatable spool defining a slot, the linking member being received in the slot.

7. The mechanism of claim 1, wherein the control and the lock member rotate about a first axis, and wherein the tilt-latch actuator rotates about a second axis offset from the first axis.

8. The mechanism of claim 1, further comprising a reinforcing insert adapted to be received in the sash, and wherein the at least one tilt-latch mechanism is received in the reinforcing insert.

9. The mechanism of claim 1, wherein the plunger latch includes a trigger portion extending in the direction of travel of the plunger latch.

10. An integrated lock and tilt-latch mechanism for a sliding window, the window including a frame with at least one sliding sash therein, the sash also tiltably positionable relative to the frame, the mechanism comprising:

an actuator mechanism and at least one tilt-latch adapted for mounting on the sash, and a flexible linking member;

the actuator mechanism including a housing, a control, a lock member, and a tilt-latch actuator member, the lock member and the tilt-latch actuator member operably coupled with the control, the tilt-latch actuator having structure for receiving and applying tension to the flexible linking member;

the at least one tilt-latch including:

a tilt-latch housing presenting a longitudinal axis and having an aperture defined in a first end thereof; and a plunger disposed in the tilt-latch housing, the plunger having a latch bolt portion and being selectively slidably shiftable along the longitudinal axis between an extended position in which the latch bolt portion of the plunger projects through the aperture and a retracted position in which the latch bolt portion of the plunger is substantially within the tilt-latch housing, the plunger defining a channel for receiving the flexible linking member and having a locking member positioned proximate the channel, the locking member selectively shiftably adjustable from a location outside the tilt-latch housing between a first position in which the flexible linking member is freely slidable in the channel to enable insertion and removal of the flexible linking member, and a second position in which the locking member is engaged with the flexible linking member to fixedly secure the flexible linking member in the channel, thereby operably coupling the tilt-latch actuator with the plunger of the tilt-latch;

wherein the control is selectively positionable between at least three positions including a locked position in which the lock member is positioned so that a portion of the lock member extends from the housing of the actuator mechanism, an unlocked position in which the lock member is positioned substantially within the housing of the actuator mechanism, and a tilt position in which the lock member is positioned substantially within the housing of the actuator mechanism and the plunger of the tilt-latch mechanism is positioned in the retracted position.

11. The mechanism of claim 10, wherein the tilt-latch further includes a plunger latch member and first and second biasing members, the first biasing member arranged so as to bias the plunger toward the extended position, the plunger latch member operably coupled with the housing and arranged so as to be selectively slidably shiftable in a direction transverse to the longitudinal axis when the plunger is in the retracted position, the plunger latch member shiftable between a first position in which the plunger latch member engages and prevents shifting of the plunger and a second position in which the plunger latch member enables shifting of the plunger, the second biasing member arranged so as to bias the plunger latch member toward the first position.

12. The mechanism of claim 11, wherein the plunger latch includes a trigger portion extending in the direction of travel of the plunger latch.

13. The mechanism of claim 10, wherein the lock member comprises a sweep cam.

14. The mechanism of claim 10, wherein the control comprises a rotatable lever.

15. The mechanism of claim 10, further comprising a keeper for receiving the lock member when the control is positioned in the locked position.

16. The mechanism of claim 10, further comprising a second tilt-latch mechanism.

17. The mechanism of claim 16, wherein the linking member is a continuous strip of polymer material extending between the tilt-latch mechanisms, wherein the actuator mechanism is positioned intermediate the tilt-latch mechanisms, and wherein the tilt-latch actuator comprises a rotatable spool defining a slot, the linking member being received in the slot.

18. The mechanism of claim 10, wherein the control and the lock member rotate about a first axis, and wherein the tilt-latch actuator member rotates about a second axis offset from the first axis.

19. The mechanism of claim 10, further comprising a reinforcing insert adapted to be received in the sash, and wherein the at least one tilt-latch mechanism is received in the reinforcing insert.

20. A window comprising:

a frame;

a first sash and a second sash, each slidable in the frame, the first sash also tiltably positionable relative to the frame; and an integrated lock and tilt-latch mechanism on the first sash, the mechanism comprising:

an actuator mechanism and at least one tilt-latch adapted for mounting on the sash, and a flexible linking member, the actuator mechanism including a housing, a control, a lock member, and a tilt- latch actuator member, the lock member and the tilt-latch actuator member operably coupled with the control, the tilt-latch actuator having structure for receiving and applying tension to the flexible linking member;

the at least one tilt-latch including:

a tilt-latch housing presenting a longitudinal axis and having an aperture defined in a first end thereof; and a plunger disposed in the tilt-latch housing, the plunger having a latch bolt portion and being selectively slidably shiftable along the longitudinal axis between an extended position in which the latch bolt portion of the plunger projects through the aperture and a retracted position in which the latch bolt portion of the plunger is substantially within the tilt-latch housing, the plunger defining a channel for receiving the flexible linking member and having a locking member positioned proximate the channel, the locking member selectively shiftably adjustable from a location outside the tilt-latch housing between a first position in which the flexible linking member is freely slidable in the channel to enable insertion and removal of the flexible linking member, and a second position in which the locking member is engaged with the flexible linking member to fixedly secure the flexible linking member in the channel, thereby operably coupling the tilt-latch actuator with the plunger of the tilt-latch;

wherein the control is selectively positionable between at least three positions including a locked position in which the lock member is positioned so that a portion of the lock member extends from the housing of the actuator mechanism, an unlocked position in which the lock member is positioned substantially within the housing of the actuator mechanism, and a tilt position in which the lock member is positioned substantially within the housing of the actuator mechanism and the plunger of the tilt-latch mechanism is positioned in the retracted position.

21. The window of claim 20, wherein the tilt-latch further includes a plunger latch member and first and second biasing members, the first biasing member arranged so as to bias the plunger toward the extended position, the plunger latch member operably coupled with the housing and arranged so as to be selectively slidably shiftable in a direction transverse to the longitudinal axis when the plunger is in the retracted position, the plunger latch member shiftable between a first position in which the plunger latch member engages and prevents shifting of the plunger and a second position in which the plunger latch member enables shifting of the plunger, the second biasing member arranged so as to bias the plunger latch member toward the first position.

22. The window of claim 20, further comprising a second tilt-latch mechanism.

23. The window of claim 22, wherein the linking member is a continuous strip of polymer material extending between the tilt-latch mechanisms, wherein the actuator mechanism is positioned intermediate the tilt-latch mechanisms, and wherein the tilt-latch actuator comprises a rotatable spool defining a slot, the linking member being received in the slot.

* * * * *